US008354782B2

(12) United States Patent
Sakayanagi et al.

(10) Patent No.: US 8,354,782 B2
(45) Date of Patent: Jan. 15, 2013

(54) SPARK PLUG

(75) Inventors: Nobuaki Sakayanagi, Toyohashi (JP); Katsutoshi Nakayama, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 145 days.

(21) Appl. No.: 13/061,991

(22) PCT Filed: Jul. 12, 2010

(86) PCT No.: PCT/JP2010/004497

§ 371 (c)(1), (2), (4) Date: Mar. 3, 2011

(87) PCT Pub. No.: WO2011/016181

PCT Pub. Date: Feb. 10, 2011

(65) Prior Publication Data

US 2011/0148276 A1 Jun. 23, 2011

(30) Foreign Application Priority Data

Aug. 3, 2009 (JP) ..... 2009-180483

(51) Int. Cl.
*H01T 13/20* (2006.01)

(52) U.S. Cl. ..... 313/141; 313/143

(58) Field of Classification Search ..... 313/118, 313/141–144; 445/7; 123/143, 169 R
See application file for complete search history.

(56) References Cited

U.S. PATENT DOCUMENTS

| | | | |
|---|---|---|---|
| 5,440,198 | A | 8/1995 | Oshima et al. |
| 6,215,235 | B1 | 4/2001 | Osamura |
| 6,528,929 | B1 | 3/2003 | Matsutani et al. |
| 2005/0057133 | A1 | 3/2005 | Hori |

FOREIGN PATENT DOCUMENTS

| | | | |
|---|---|---|---|
| JP | 6-36856 | A | 2/1994 |
| JP | 11-233233 | A | 8/1999 |
| JP | 2002-289319 | A | 10/2002 |
| JP | 2003-017214 | A | 1/2003 |
| JP | 2005-93221 | A | 4/2005 |
| JP | 2006-269441 | A | 10/2006 |

*Primary Examiner* — Anh Mai
*Assistant Examiner* — Elmito Breval
(74) *Attorney, Agent, or Firm* — Sughrue Mion, PLLC

(57) ABSTRACT

Separation of a noble metal tip is prevented and wear resistance is enhanced, while the increase in manufacturing cost is suppressed. A spark plug 1 includes a center electrode 5 and a noble metal tip 31. The center electrode 5 and the noble metal tip 31 are joined to each other through a molten portion 35. An area of an interface between the noble metal tip 31 and the center electrode 5 is set to be 5% or less with respect to a cross-sectional area of the noble metal tip 31 which is perpendicular to an axial line CL1 at a portion of an outer surface of the noble metal tip 31 which is nearest to the molten portion 35. In the cross section including the axial line CL1, supposing that a length of the portion of the molten portion 35 in the axial line CL1 which is exposed to the outer surface is A (mm), and a width of the noble metal tip 31 is B (mm), B/A≦6 is satisfied. The portion of the molten portion 35, of which a length along the axial line CL1 is A/1.5, is located further outwards radially than a position which comes in by as much as B/4 from the outer circumference of the noble metal tip 31.

8 Claims, 12 Drawing Sheets

SPARK PLUG

TECHNICAL FIELD

The present invention relates to a spark plug for use in an internal combustion engine or the like.

BACKGROUND ART

A spark plug for use in a combustion apparatus, such as an internal combustion engine or the like, includes, for example, a center electrode extending in an axial direction, an insulating body provided around an outer circumference of the center electrode, a cylindrical metal shell attached to an outer circumference of the insulating body, and a ground electrode having a proximal end portion joined to a distal end portion of the metal shell. The ground electrode is arranged, with its roughly middle portion being bent, such that a distal end portion of the ground electrode opposes the distal end portion of the center electrode, whereby a spark discharge gap is formed between the distal end portion of the center electrode and the distal end portion of the ground electrode. In addition, recently, there has been proposed a technique for enhancing wear resistance by joining a noble metal tip to the spark discharge gap forming portion of the distal end portion of the center electrode or the distal end portion of the ground electrode. In this instance, the noble metal alloy constituting the noble metal tip is expensive, and thus, in order to suppress an increase in manufacturing cost, the use of a relatively thin noble metal tip is considered.

When the noble metal tip and the center electrode are joined to each other, laser welding using a YAG laser is generally used (for example, refer to Patent Document 1). That is, the laser beam is intermittently irradiated onto the outer circumference of the border portion between the noble metal tip and the center electrode, so that a molten portion is formed by fusing each component to join the noble metal tip and the center electrode together.

RELATED ART DOCUMENT

Patent Document

[Patent document 1]: JP-A-2003-17214

SUMMARY OF INVENTION

Problems that the Invention is to Solve

However, in order to maintain the sufficient joining strength, increased irradiation energy is needed to further insert the molten portion inwardly (axial line side). However, in the case of using the YAG laser, the volume of the molten portion on the outer circumference side is relatively increased. For this reason, if the relatively thin noble metal tip is used, the outer circumference side of the molten portion comes to a surface (discharge surface) forming a spark discharge gap between the ground electrode and the molten portion, so that the working effect of enhancing the wear resistance by installing the noble metal tip may not be sufficiently achieved.

In that regard, reducing the volume of the molten portion by decreasing the irradiation energy of the laser beam to prevent the molten portion from being exposed to the discharge surface has been considered. However, the reduced molten portion causes the joining strength between the noble metal tip and the center electrode to decrease, and thus the noble metal tip may be separated.

These problems can be caused by not only the case where the noble metal tip is joined to the distal end portion of the center electrode, but also the case where a protrusion is provided on the distal end portion of the ground electrode and the noble metal tip is joined to the protrusion.

The invention has been made in view of the above-described circumstances, and on object of the invention is to provide a spark plug which can prevent separation of a noble metal tip and enhance wear resistance, while the increase in manufacturing cost is suppressed.

Means for Solving the Problem

Hereafter, configurations suitable for achieving the above-described object will be described in an itemized fashion. Notably, when necessary, effects peculiar to each configuration will be added.

First Aspect

A spark plug comprising: a rod-shaped center electrode extending in an axial direction; an insulating body provided around an outer circumference of the center electrode; a metal shell provided around an outer circumference of the insulating body; a ground electrode extending from a distal end portion of the metal shell; and a noble metal tip joined to a distal end portion of the center electrode, and forming a gap between the ground electrode and the noble metal tip, wherein the center electrode and the noble metal tip are joined to each other through a molten portion which is fused with a component of the center electrode and a component of the noble metal tip; an area of an interface between the noble metal tip and the center electrode is set to be 5% or less with respect to a cross-sectional area of the noble metal tip which is perpendicular to an axial line at a portion, which is nearest to the molten portion, of an outer surface of the noble metal tip; in the cross section including the axial line, supposing that a length of a portion, which is exposed to the outer surface is A (mm), of the molten portion along the axial line, and a width of the noble metal tip is B (mm), $A \leqq 0.6$ and $B/A \leqq 6$ are satisfied; and the portion of the molten portion, of which a length along the axial line is A/1.5, is located further outwards radially than a position which comes in by as much as B/4 from the outer circumference of the noble metal tip.

According to the first aspect, in view of further enhancing wear resistance or the like by reducing the volume of the molten portion, it is preferable that the molten portion be configured in such a manner that the portion of the molten portion, of which the length in the axial line is set to be A/1.5, is further outwards radially than the position which comes in by as much as B/5 from the outer circumference of the noble metal tip, more preferably, the portion of the molten portion, of which the length in the axial line is set to be A/1.5, is further outwards radially than the position which comes in by as much as B/6 from the outer circumference of the noble metal tip.

Second Aspect

The spark plug according to the first aspect, wherein the center electrode is provided therein with a heat radiation promoting portion made of a material superior to the outer circumference of the center electrode in terms of thermal conductivity, and supposing that the shortest length from the heat radiation promoting portion to the molten portion is C (mm), $C \leqq 2.0$ is satisfied.

Third Aspect

A spark plug comprising: a rod-shaped center electrode extending in an axial direction; an insulating body provided around an outer circumference of the center electrode; a metal shell provided around an outer circumference of the insulating body; a ground electrode extending from a distal end portion of the metal shell; and a noble metal tip joined to a protrusion provided on a distal end portion of the ground electrode, and forming a gap between the center electrode and the noble metal tip, wherein the protrusion and the noble metal tip are joined to each other through a molten portion which is fused with a component of the protrusion and a component of the noble metal tip; an area of an interface between the noble metal tip and the protrusion is set to be 5% or less with respect to a cross-sectional area of the noble metal tip which is perpendicular to an axial direction of the noble metal tip at a portion, which is nearest to the molten portion, of an outer surface of the noble metal tip; in the cross section including the axial line, supposing that a length of a portion, which is exposed to the outer surface is A (mm), of the molten portion in the axial direction of the noble metal tip, and a width of the noble metal tip is B (mm), $A \leqq 0.6$ and $B/A \leqq 6$ are satisfied; and the portion of the molten portion, of which a length along the axial direction of the noble metal tip is A/1.5, is located further outwards radially than a position which comes in by as much as B/4 from the outer circumference of the molten portion.

Fourth Aspect

The spark plug according to any one of the first aspect to the third aspect, wherein $A \leqq 0.4$ is satisfied.

Fifth Aspect

The spark plug according to any one of the first aspect to the fourth aspect, wherein, on an axis of the noble metal tip, supposing that a length from a surface, which forms the gap, of the noble metal tip to a center of the molten portion or the interface is D (mm), $0.1 \leqq D-(A/2) \leqq 0.6$ is satisfied.

Sixth Aspect

The spark plug according to any one of the first aspect to the fifth aspect, wherein, on an axis of the noble metal tip, supposing that a length from a surface, which forms the gap, of the noble metal tip to a center of the molten portion or the interface is D (mm), $0.3 \leqq D \leqq 0.5$ is satisfied.

Seventh Aspect

The spark plug according to any one of the first aspect to the sixth aspect, wherein, on an axis of the noble metal tip, supposing that a thickness of the molten portion is E (mm), $E>0.0$ is satisfied.

Eighth Aspect

The spark plug according to the six aspect or the seventh aspect, wherein in a cross section including the axial line, supposing that a cross-sectional area of the portion of the molten portion, which is positioned at the noble metal tip side from a straight line perpendicular to a central axis of the noble metal tip and passing through a central portion of the molten portion in a direction of the axial line of the noble metal tip, is X ($mm^2$), and a cross-sectional area of the noble metal tip is Y ($mm^2$), $0.025 \leqq X/(X+Y) \leqq 0.50$ is satisfied.

Effects of the Invention

According to the spark plug of the first aspect, the area of the interface between the noble metal tip and the center electrode is set to be 5% or less with respect to the cross-sectional area of the noble metal tip in the direction perpendicular to the axial line of the noble metal tip. In other words, before the molten portion is formed, the molten portion is formed over the region of 95% or more of the contact region between the center electrode and the noble metal tip. Accordingly, the noble metal tip is firmly joined to the center electrode, thereby enhancing the mechanical strength against vibration or the like.

In addition, as described above, the molten portion is formed over the region of 95% or more, and supposing that the length of the portion, which is exposed to the outer surface, the molten portion along the axial line is A, and the width of the noble metal tip is B, the molten portion is formed such that $B/A \leqq 6$ is satisfied. For this reason, the stress difference generated due to the difference in coefficient of thermal expansion between the center electrode and the noble metal tip during use can be absorbed by the molten portion formed to have a sufficient thickness over the relatively large region, thereby preventing the formation of crack (breaking) between the center electrode and the noble metal tip. As a result, since the mechanical strength is enhanced and the joining strength between the center electrode and the noble metal tip is sufficiently secured, a separation of the noble metal tip can be prevented.

Further, according to the first aspect, the portion of the molten portion, of which the length along the axial line is A/1.5, is configured such that it is located further outwards radially than the position which comes in by as much as B/4 from the outer circumference of the noble metal tip. That is, the molten portion is formed in such a manner that the length of the portion of the radial outside is relatively abruptly reduced along the axial line toward the inward (axial line side) from the outer surface of the molten portion, and in the portion positioned at the radial inside, the decreasing amount of the length along the axial line is relatively small. Accordingly, while the portion, which is positioned further inwards radially, of the molten portion is maintained to be relatively thin, the molten portion may reach to the center (axial line) side. For this reason, even though the molten portion is formed over a relatively large region as described above, the volume of the molten portion can be formed to be relatively small. Accordingly, it is possible to reduce the portion of the noble metal tip which is molten when joining, and thus even though the noble metal tip having a relatively thin thickness is used, the noble metal tip 31 has a sufficient thickness (volume) after joining. As a result, it is possible to enhance the wear resistance while suppressing the manufacturing cost.

According to the spark plug of the second aspect, the shortest length C from the molten portion to the heat radiation promoting portion is 2.0 mm or less. For this reason, the heat of the molten portion and the heat of the noble metal tip adjacent to the molten portion can be effectively transmitted to the heat radiation promoting portion having superior heat conductivity. As a result, it is possible to reliably prevent the overheating of the noble metal tip, and thereby to further enhance the wear resistance.

According to the spark plug of the third aspect, the effect obtained by the first aspect shown in the relationship between the center electrode and the noble metal tip can be shown in the relationship between the protrusion and the noble metal tip in the case where the noble metal tip is joined to the protrusion of the ground electrode.

According to the spark plug of the fourth aspect, since the length of the outer surface of the molten portion along the axial line is small at 0.4 mm or less, the volume of the molten portion can be further decreased. Accordingly, it is possible to further secure the thickness of the noble metal tip after joining, and thereby to further enhance the wear resistance.

According to the spark plug of the fifth aspect, since D−(A/2) is set to be 0.1 or more, it is possible to sufficiently secure the thickness of the noble metal tip, and thereby to further enhance the wear resistance.

According to the spark plug of the sixth aspect, since $0.3 \leqq D$ is set, the noble metal tip having the superior wear resistance has the sufficient thickness. Meanwhile, since $D \leqq 0.5$ is satisfied, it is possible to suppress the volume of the noble metal tip from being exaggerated, and thereby to reliably prevent the overheating of the noble metal tip. Accordingly, these effects act together, thereby further enhancing the wear resistance.

In addition, it is possible to prevent the noble metal tip from being excessively thickened by setting $D-(A/2)$ to be 0.6 mm or less. Therefore, it is possible to more reliably prevent the overheating of the noble metal tip during use, and thereby to achieve the superior wear resistance.

According to the spark plug of the seventh aspect, the thickness E of the molten portion on the central axis of the noble metal tip becomes larger than 0.0 mm, in other words, the molten portion is formed over the whole region between the center electrode (alternatively the protrusion) and the noble metal tip. Accordingly, it is possible to more firmly join the noble metal tip to the center electrode, and to reliably absorb the stress difference generated between the center electrode (protrusion) and the noble metal tip by the molten portion. As a result, the joining strength between the center electrode (protrusion) and the noble metal tip can be further enhanced, and the separation resistance of the noble metal tip can be further enhanced.

According to the spark plug of the eighth aspect, in the relationship of the volume of the noble metal tip and the volume of the molten portion, since $0.025 \leqq X/(X+Y)$ is satisfied (that is, the volume of the molten portion with respect to the volume of the noble metal tip is sufficiently large), it is possible to further enhance the joining strength of the noble metal tip. Meanwhile, since $X/(X+Y) \leqq 0.50$ is satisfied (that is, the volume of the noble metal tip is prevented from being large with respect to the volume of the molten portion), it is possible to more reliably prevent the overheating of the noble metal tip, and thereby to further enhance the wear resistance.

EXEMPLARY DESCRIPTION OF EMBODIMENTS

Embodiment 1

Figure 1:
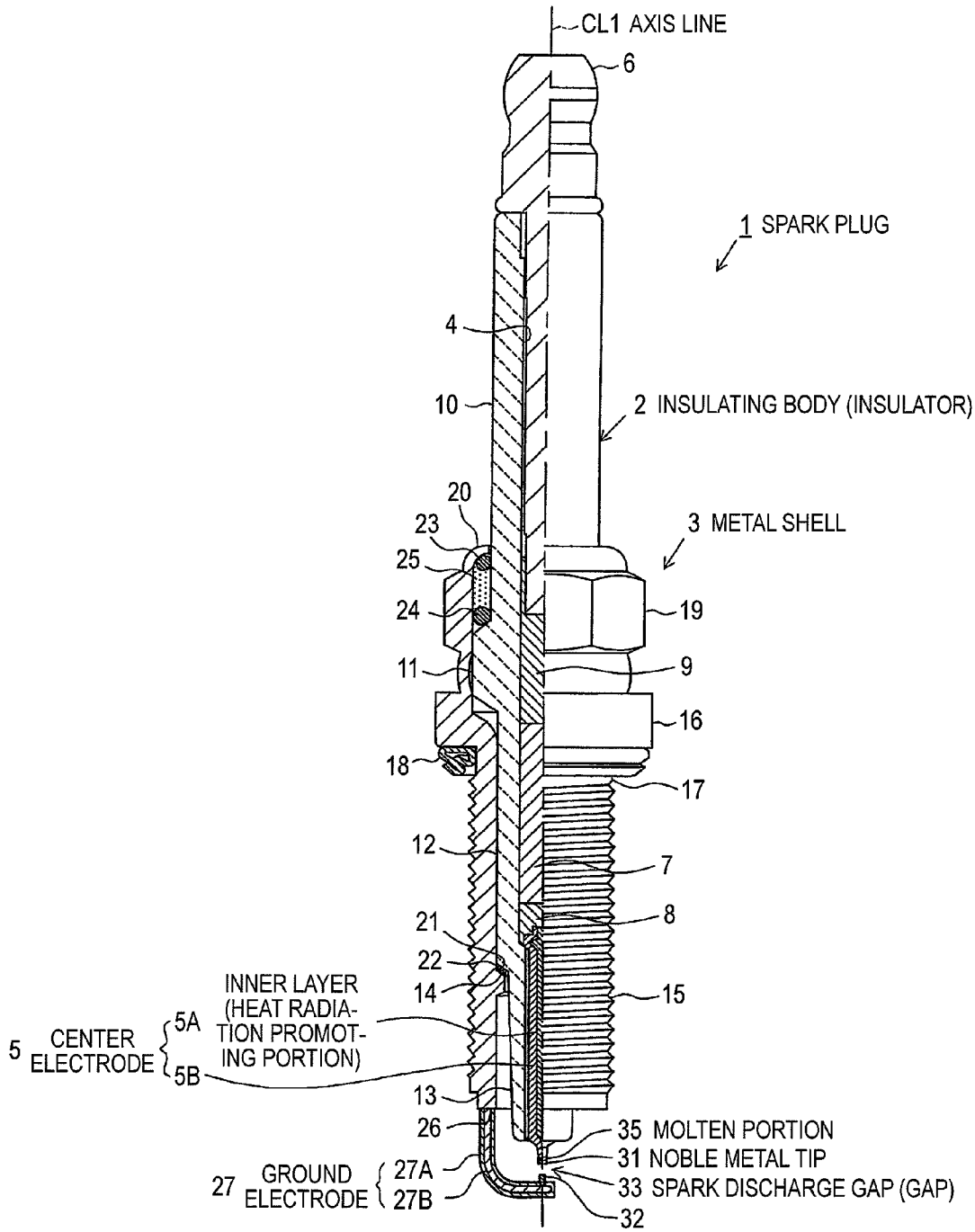
FIG. 1 is a partially-sectioned front view illustrating the configuration of a spark plug according to a first embodiment.

An embodiment will be hereinafter described by reference to the accompanying drawings. FIG. 1 is a partially-cutaway front view illustrating a spark plug 1. In FIG. 1, a direction of an axial line CL1 of the spark plug 1 is assumed to be a vertical direction in the drawing, and descriptions are provided on the assumption that a lower side is a distal end portion of the spark plug 1 and that an upper side is a rear end portion of the same.

The spark plug 1 includes a cylindrical insulator 2 acting as an insulation body, a cylindrical metal shell 3 that holds the insulator, and the like.

The insulator 2 is formed by sintering alumina and the like as is well known, and includes, on an outer shaper thereof, a rear end-side body portion 10 formed at a rear end side thereof, a large-diameter portion 11 formed on a distal end side of the rear end-side body portion 10 so as to outwardly project in a radial direction, an intermediate body portion 12 formed on the distal end side of the large-diameter portion 11 so as to have a diameter smaller than that of the large-diameter portion 11, and a leg portion 13 formed on the distal end side of the intermediate body portion 12 so as to have a diameter smaller than that of the intermediate body portion 12. In the insulator 2, the large-diameter portion 11, the intermediate body portion 12, and the majority of the leg portion 13 are housed in the metal shell 3. A tapered step portion 14 is formed in a connection between the leg portion 13 and the intermediate body portion 12, and the insulator 2 is engagedly fastened to the metal shell 3 by means of the step portion 14.

Further, an axial hole 4 is formed in the insulator 2 in a penetrating fashion along an axial line CL1. A center electrode 5 is fixedly inserted to the distal end side of the axial hole 4. The center electrode 5 as a whole has a rod shape (a columnar shape), and protrudes from the distal end portion of the insulator 2. Moreover, the center electrode 5 includes an outer layer 5B made of a Ni alloy containing nickel (Ni) as a main component, and an inner layer 5A made of, copper, copper alloy or pure nickel which is superior to the Ni alloy in terms of thermal conductivity, and serving as a heat radiation promoting portion. Further, the columnar noble metal tip 31 made of a noble metal alloy (for example, an iridium alloy) is joined to the distal end portion of the columnar center electrode 5 by a molten portion 35 which will be described in detail hereinafter. In this embodiment, the noble metal tip 31 is joined to the center electrode 5 such that the central axis of the noble metal tip 31 coincides with the axial line CL1. In addition, an outer diameter of the noble metal tip 31 is a relatively small diameter (for example, 0.7 mm).

A terminal electrode 6 is fixedly inserted into a rear end side of the axial hole 4 while projecting out from the rear end portion of the insulator 2.

In addition, a columnar resistor 7 is provided in the axial hole 4 between the center electrode 5 and the terminal electrode 6. Both ends of the resistor 7 are electrically connected to the center electrode 5 and the terminal electrode 6, respectively, by way of a conductive glass seal layers 8 and 9.

In addition, the metal shell 3 is cylindrically made of metal, such as low carbon steel, and a threaded portion (an external threaded portion) 15 to mount the spark plug 1 to a combustion device, such as an internal combustion engine, a fuel cell reformer or the like, is formed on an outer circumference of the metal shell. Furthermore, a seat portion 16 is formed on an outer circumference on the rear end side of the threaded portion 15, and a ring-shaped gasket 18 is fitted around a threaded neck 17 provided at the rear end portion of the threaded portion 15. Moreover, a tool engagement portion 19, which is used for engagement of a tool such as a wrench when the spark plug 1 is fastened to the internal combustion engine or the like and which has a hexagonal cross-sectional profile, is provided on a rear end side of the metal shell 3. A clamping portion 20 is provided on the rear end portion of the metal shell to hold the insulator 2.

Also, the internal circumference of the metal shell 3 is provided with a taper-shaped stepped portion 21 to engagedly fasten the insulator 2. The insulator 2 is inserted from the rear end side to the distal end side of the metal shell 3. An opening provided on the rear end side of the metal shell 3 is inwardly clamped in the radial direction while the stepped portion 14 of the insulator remains engagedly fastened to the stepped portion 21 of the metal shell 3; namely, the clamping portion 20 is formed, whereby the insulator 2 is fastened. An annular plate packing 22 is sandwiched between the stepped portion 14 of the insulator 2 and the stepped portion 21 of the metal shell 3. Air-tightness in a combustion chamber is thereby held, to thus prevent leakage, to the outside, of a fuel air entering a gap between the leg portion 13 of the insulator 2 exposed to the inside of the combustion chamber and the internal circumference of the metal shell 3.

Further, in order to increase the sealing achieved by clamping, annular ring members 23 and 24 are interposed between the metal shell 3 and the insulator 2 on the rear end side of the metal shell 3, and a space between the ring members 23 and 24 is filled with powder of talc (talc) 25. Specifically, the metal shell 3 holds the insulator 2 by way of the plate packing 22, the ring members 23 and 24, and the talc 25.

Moreover, a ground electrode 27 is joined to the distal end portion 26 of the metal shell 3. The ground electrode 27 is arranged, with its roughly middle portion being bent, such that the distal end face of the ground electrode opposes the distal end portion of the center electrode 5. The ground electrode 27 has a two-layer structure consisting of an outer layer 27A and an inner layer 27B. In this embodiment, the outer layer 27A is made of a Ni alloy [for example, INCONEL 600 or INCONEL 601 (both of which are registered trademarks)]. In the meantime, the inner layer 27B is made of a copper alloy or the like that is a metal superior to the Ni alloy in terms of thermal conductivity.

In addition, a columnar noble metal tip 32 made of a noble metal alloy (for example, a platinum alloy or the like) is joined to a distal end of the ground electrode 27 which opposes the distal end face of the noble metal tip 31. A spark discharge gap 33 acting as a gap is formed between the noble metal tip 31 and the noble metal tip 32, and spark discharge is emitted in a direction substantially along the axial line CL1.

Figure 2:
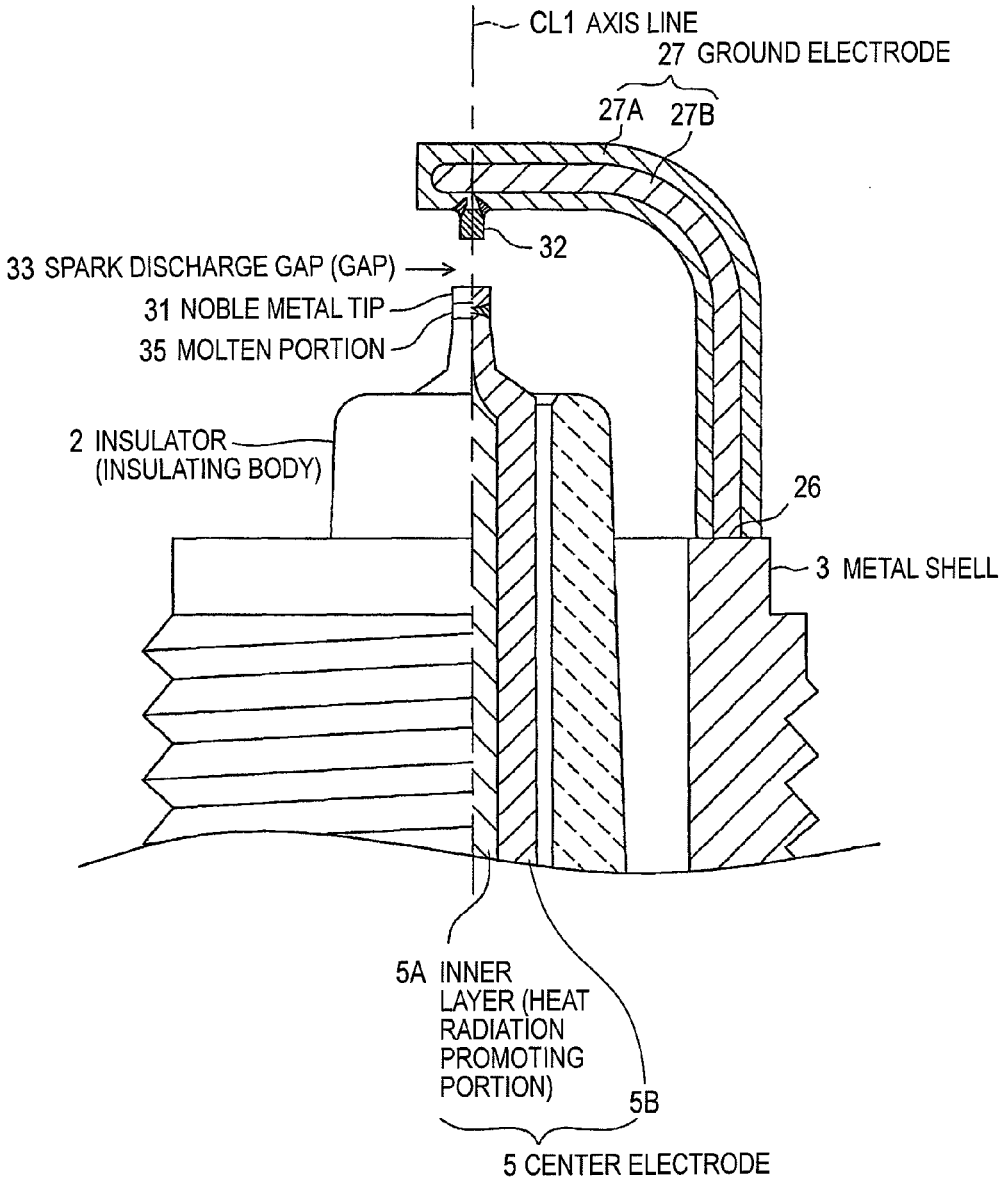
FIG. 2 is a partially-cutaway enlarged front view illustrating the configuration of a distal end portion of a spark plug according to a first embodiment.
Figure 3:
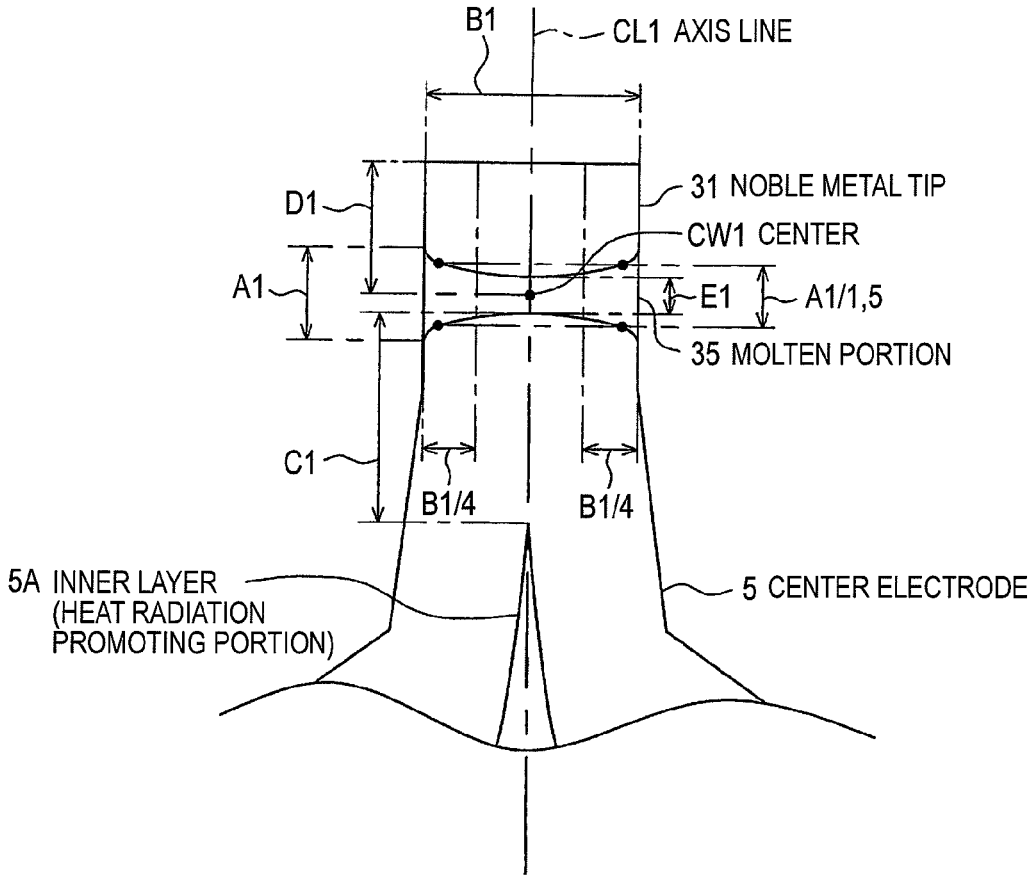
FIG. 3 is a partially-enlarged cross-sectional view schematically illustrating the configuration of a molten portion and the like according to a first embodiment.
Figure 15:
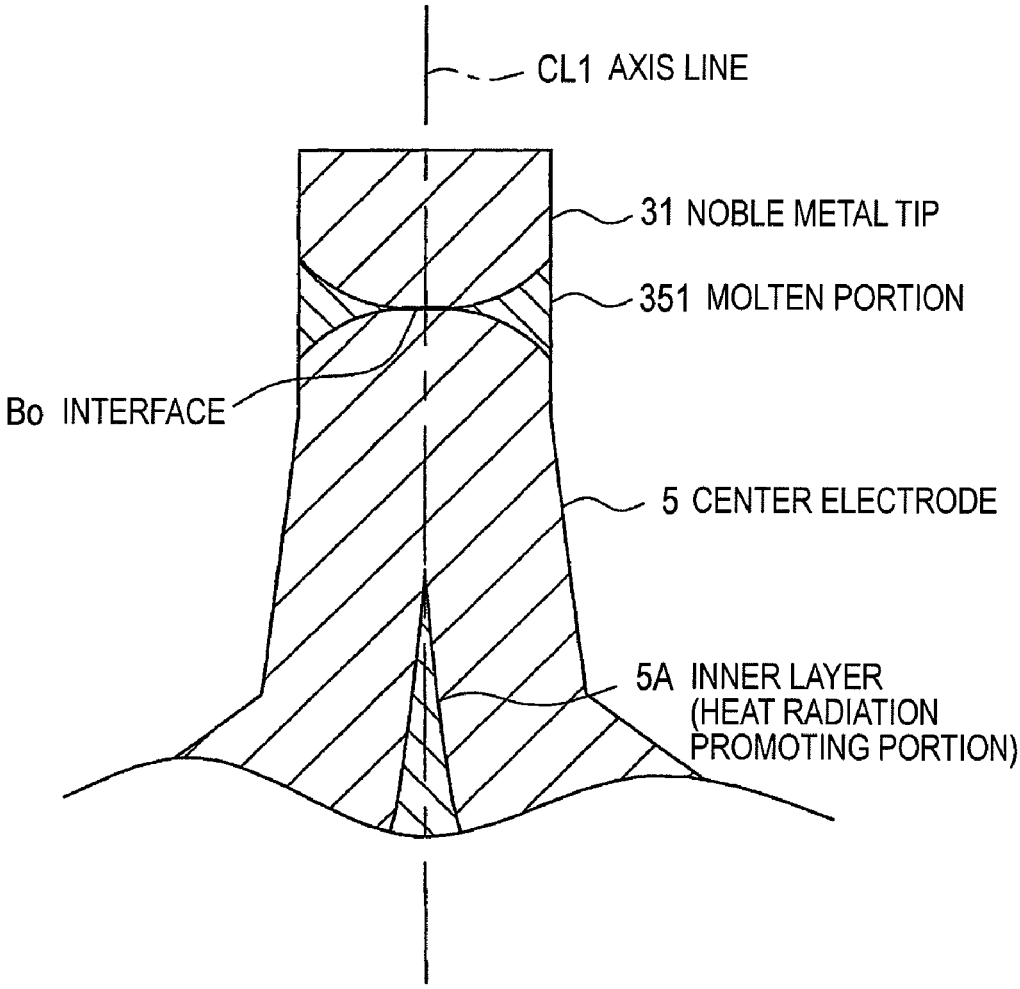
FIG. 15 is a partially-enlarged cross-sectional view illustrating a molten portion of a different shape.

Further, in this embodiment, the molten portion 35 is formed by welding a metal component of the center electrode 5 and a metal component of the noble metal tip 31 through laser welding using a fiber laser or an electron beam (a method of forming the molten portion 35 will be described hereinafter). In addition, in this embodiment, as shown in FIG. 2 and FIG. 3, the center electrode 5 and the noble metal tip 31 are not brought into direct contact with each other (in other words, an interface is not formed between the noble metal tip 31 and the center electrode 5), and are joined to each other through the molten portion 35. As shown in FIG. 15, the molten portion 35 may be formed such that the interface Bo, at which the center electrode 5 and the noble metal tip 31 come into direct contact with each other, is formed between the noble metal tip 31 and the center electrode 5. In this instance, an area of the interface Bo between the noble metal tip 31 and the center electrode 5 is set to be 5% or less with respect to a cross-sectional area of the noble metal tip 31 in a direction perpendicular to the axial line CL1 at a portion of the outer surface of the noble metal tip 31 which is nearest to the molten portion 351. In other words, before the molten portion 351 is formed, the molten portion 351 is formed over the region of 95% or more of the contact region between the center electrode 5 and the noble metal tip 31.

Returning to FIG. 3, in the cross section including the axial line CL1, supposing that the length of the portion of the molten portion 35 in the axial line CL1 which is exposed to the outer surface is A1 (mm), and the width (meaning "the length of the noble metal tip 31 in a direction perpendicular to an axial line CL1") of the noble metal tip 31 is B1 (mm), the sizes of the molten portion 35 and the noble metal tip 31 are set such that $B1/A1 \leqq 6$ is satisfied.

In addition, a portion of the molten portion 35 which is exposed to the outer surface has a relatively small size (corresponding to a diameter of a so-called bead) such that the length A1 satisfies $A1 \leqq 0.6$, that is, the molten portion 35 is not excessively large.

Further, in the cross section including the axial line CL1, the portion of the molten portion 35, of which the length along the axial line CL1 is A1/1.5, is located further outwards radially than a position which comes in by as much as B1/4 from the outer circumference of the noble metal tip 31. That is, the molten portion 35 is formed such that its length in the axial line CL1 is decreased relatively rapidly at the portion of the radial outside (between the portion on the outer circumference of the molten portion 35 and the position coming in by as much as B1/4 from the outer circumference of the noble metal tip 31) towards the inside (the axial line CL1 side) from the outer surface of the molten portion 35, and the decreasing amount of the length in the axial line CL1 is relatively small on the portion which is positioned on the radial inside. For this reason, in this embodiment, in the cross section including the axial line CL1, the interface between the molten portion 35 and the noble metal tip 31 and the interface between the molten portion 35 and the center electrode 5 are respectively formed in a curved shape which is recessed toward the outer circumference of the molten portion 35.

In addition, supposing that the shortest length from the inner layer 5A provided in the center electrode 5 to the molten portion 35 is C1 (mm), the forming position of the inner layer 5A in the center electrode 5 is set such that $0<C1\leqq 2.0$ is satisfied, that is, the length from the inner layer 5A to the molten portion 35 is relatively short.

Further, on the axial line CL1 (on the central axis of the noble metal tip 31), supposing that the length from the surface (the distal end surface), which forms the spark discharge gap 33, of the noble metal tip 31 to the center CW1 of the molten portion 35 is D1 (mm), the length (thickness) of the noble metal tip 31 in the direction of the axial line CL1 is set such that $0.1\leqq D1-(A1/2)\leqq 0.6$ and $0.3\leqq D1\leqq 0.5$ are satisfied. In this instance, if the interface Bo is formed between the noble metal tip 31 and the center electrode 5, the length D1 means the length from the surface (the distal end surface), which forms the spark discharge gap 33, of the noble metal tip 31 to the interface Bo on the axial line CL1 (on the central axis of the noble metal tip 31).

In this embodiment, as described hereinbefore, since the center electrode 5 and the noble metal tip 31 are not brought into direct contact with each other, the interface is not formed between the center electrode 5 and the noble metal tip 31. For this reason, the thickness E1 (mm) of the molten portion 35 in the axial line CL1 (the central axis of the noble metal tip 31) satisfies $E1>0.0$.

Figure 4:
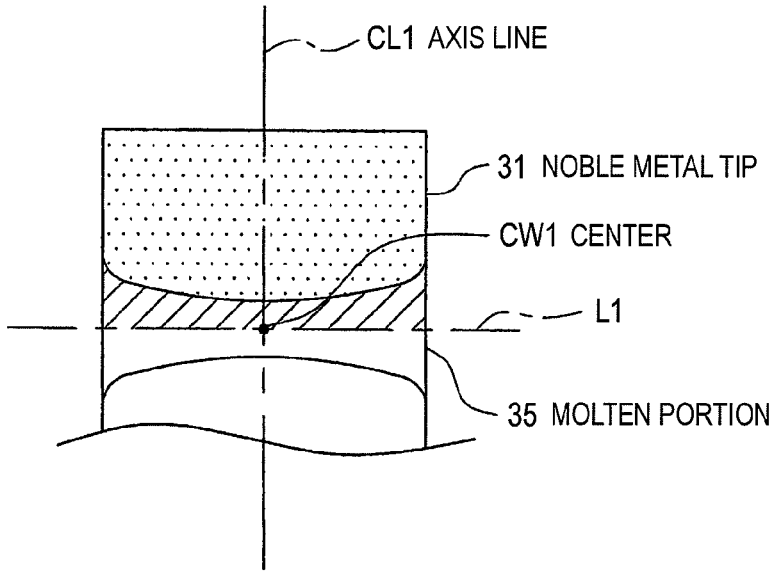
FIG. 4 is a partially-enlarged cross-sectional view schematically illustrating a cross-sectional area of a molten portion and a noble metal tip and the like according to a first embodiment.

As shown in FIG. 4, in the cross section including the axial line CL1, supposing that the cross-sectional area of the portion (portion represented by diagonal lines in FIG. 4) of the molten portion 35, which is positioned at the noble metal tip 31 side from the straight line L1 perpendicular to the axial line CL1 and passing through the central portion (center CW1) of the molten portion 35 in the direction of the axial line CL1, is X1 ($mm^2$), and the cross-sectional area of the noble metal tip 31 (portion represented by scattered dots in FIG. 4) is Y1 ($mm^2$), the shapes of the molten portion 35 and the noble metal tip 31 or the like are set such that $0.025\leqq X1/(X1+Y1)\leqq 0.50$ is satisfied.

Next, a method of manufacturing the spark plug 1 configured as described above will be described. First, the metal shell 3 is pre-fabricated. That is, cold forging operation is performed on a columnar metal material (for example, iron material or stainless steel material) so as to form a through-hole therein and impart a rough shape to the metal material. Subsequently, a cutting operation is performed on the metal material so as to impart a predetermined outer shape to the metal material to thereby obtain a metal shell intermediate.

Subsequently, the rod-shaped ground electrode 27 made of a Ni alloy is resistance-welded to the distal end face of the metal shell intermediate. Since a so-called "sagging" is produced as a result of the welding, the "sagging" is removed. Subsequently, the threaded portion 15 is formed in a predetermined region of the metal shell intermediate by means of rolling. Thus, the metal shell 3 to which the ground electrode 27 has been welded is obtained. Zinc plating or nickel plating is performed on the metal shell 3 to which the ground electrode 27 has been welded. Notably, in order to improve corrosion resistance, chromate treatment may be performed on the surface.

In the meantime, the insulator 2 is molded in advance separately from the metal shell 3. For example, a granulated base material for a molding is prepared by use of a powdery material that includes alumina as the main component and that also contains a binder, and the like, and rubber press molding is performed by use of the granulated base material, whereby a cylindrical molded element is obtained. The thus-obtained molded element is ground, to thus be trimmed. The thus-trimmed element is charged into a kiln and sintered, whereby the insulator 2 is obtained.

Separately from the metal shell 3 and the insulator 2, the center electrode 5 is previously manufactured. Specifically, a Ni alloy is forged to manufacture the center electrode 5, in which a copper alloy or the like is provided at the center of the Ni alloy in an attempt to enhance a heat radiation characteristic. Next, the noble metal tip 31 is laser-welded to the distal end portion of the center electrode 5.

More specifically, in the state where the proximal end face of the columnar noble metal tip 31 is stacked on the distal end face of the center electrode 5 (the outer layer 5B), the noble metal tip 31 is supported by a desired pressing pin, and the center electrode 5 and the like are turned around the axis line CL1 as a rotation axis. At that time, a high-energy laser beam such as a fiber laser or an electron beam is intermittently irradiated onto the outer circumference of the contact surface between the center electrode 5 and the noble metal tip 31. As a result, the molten portion 35 constituting of a plurality of molten regions arranged in a circumferential direction is formed, so that the noble metal tip 31 is joined to the distal end portion of the center electrode 5. Specifically explaining the irradiation conditions of the laser beam in this embodiment, the laser beam is irradiated in about 5 ms at 300 W from a desired laser source to form one molten region. In this instance, in a case where a material forming the outer diameter of the noble metal tip 31 is different from a material forming the noble metal tip 31 or the like, the molten portion 35 configured as described above can be formed by appropriately adjusting an output of the laser beam, an irradiation time, a rotation speed of the center electrode 5, or a method of applying the laser beam (for example, whether the laser is selected as a continuous wave, an interrupted wave (pulse) or the like).

Then, the insulator 2, the center electrode 5, the resistor 7, and the terminal electrode 6, which are thus acquired, are fixedly sealed by glass seal layers 8 and 9. The glass seal layers 8 and 9 are usually prepared by mixing together borosilicate glass and metal powder. The thus-prepared substance is poured into the axial hole 4 of the insulator 2 in such a way that the resistor 7 is sandwiched, and the prepared substance is subsequently pressed by the terminal electrode 6 from behind while the insulator 2 is heated in the kiln, whereby the glass seal layer is fired and hardened. At this time, a glazing layer can also be simultaneously sintered over the surface of the body 10 on the rear end side of the insulator 2, or the glazing layer can also be formed in advance.

Subsequently, the insulator 2 having the center electrode 5 and the terminal electrode 6, which are manufactured as mentioned above, and the metal shell 3 having the ground electrode 27 are assembled together. More specifically, the opening that is comparatively, thinly formed on the rear end side of the metal shell 3 is clamped inwardly with respect to the radial direction; namely, the clamping portion 20 is formed, whereby the insulator 2 and the metal shell 3 are fastened together.

Next, the noble metal tip 32 is resistance-welded or laser-welded to the distal end portion of the ground electrode 27 which is subjected to plating removal. Finally, the intermediate portion of the ground electrode 27 is bent toward the center electrode 5 side, and machining for adjusting the size of the spark between the noble metal tips 31 and 32 is carried out, thereby obtaining the spark plug 1.

As aforementioned in detail, according to the embodiment, the area of the interface between the noble metal tip 31 and the center electrode 5 is set to be 5% or less with respect to the cross-sectional area of the noble metal tip 31 in the direction perpendicular to the axial line (axial line CL1) of the noble metal tip 31. In other words, before the molten portion 35 is formed, the molten portion 35 is formed over the region of 95% or more of the contact region between the center electrode 5 and the noble metal tip 31. Accordingly, the noble metal tip 31 is firmly joined to the center electrode 5, thereby enhancing the mechanical strength against vibration or the like.

In addition, the molten portion 35 is formed over the region of 95% or more, and supposing that the length of the portion of the molten portion 35 in the axial line CL1 which is exposed to the outer surface is A1 (mm), and the width of the noble metal tip 31 is B1 (mm), the molten portion 35 is formed such that B1/A1≦6 is satisfied. For this reason, the stress difference generated due to the difference in coefficient of thermal expansion between the center electrode 5 and the noble metal tip 31 during use can be absorbed by the molten portion 35 formed to have a sufficient thickness over the relatively large region, thereby preventing the formation of crack (breaking) between the center electrode 5 and the noble metal tip 31. As a result, since the mechanical strength is enhanced and the joining strength between the center electrode 5 and the noble metal tip 31 is sufficiently secured, a separation resistance of the noble metal tip 31 is enhanced.

Further, according to this embodiment, the portion of the molten portion 35, of which the length along the axial line CL1 is A1/1.5, is configured such that it is located further outwards radially than the position which comes in by as much as B1/4 from the outer circumference of the noble metal tip 31. Accordingly, while the portion of the molten portion 35 which is positioned further inwards radially is maintained to be relatively thin, the molten portion 35 may reach to the center (axial line) side. For this reason, even though the molten portion 35 is formed over a relatively large region as described above, the volume of the molten portion 35 can be formed to be relatively small. Accordingly, it is possible to reduce the portion of the noble metal tip 31 which is molten when joining, and thus even though the noble metal tip 31 having a relatively thin thickness is used, the noble metal tip 31 has a sufficient thickness (volume) after joining. As a result, it is possible to achieve the superior wear resistance while suppressing the manufacturing cost.

In addition, since the shortest length C1 from the molten portion 35 to the inner layer 5A is 2.0 mm or less, the heat of the molten portion 35 and the heat of the noble metal tip 31 can be effectively transmitted to the inner layer 5A having the superior heat conductivity. As a result, it is possible to reliably prevent the overheating of the noble metal tip 31, and thereby to further enhance the wear resistance.

Further, since the length of the outer surface of the molten portion 35 in the axial length CL1 is small at 0.4 mm or less, the volume of the molten portion 35 can be further decreased. Accordingly, it is possible to further secure the thickness of the noble metal tip 31 after joining, and thereby to further enhance the wear resistance.

In addition, since D1−(A1/2) is set to be 0.1 mm or more, it is possible to sufficiently secure the thickness of the noble metal tip 31, and thereby to further enhance the wear resistance. On the other hand, it is possible to prevent the noble metal tip 31 from being excessively thickened by setting D1−(A1/2) to be 0.6 mm or less. Therefore, it is possible to more reliably prevent deterioration in the wear resistance due to the overheating of the noble metal tip 31.

Further, since 0.3≦D1≦0.5 is set, it is possible to prevent the overheating of the noble metal tip 31, so that the noble metal tip 31 has the sufficient thickness. For this reason, the wear resistance can be more enhanced.

In addition, according to this embodiment, the thickness E1 of the molten portion 35 on the central axis of the noble metal tip 31 becomes larger than 0 mm, in other words, the molten portion 35 is formed over the whole region between the center electrode 5 and the noble metal tip 31. Accordingly, the joining strength between the center electrode 5 and the noble metal tip 31 can be further enhanced, and the separation resistance of the noble metal tip 31 can be further enhanced.

Further, since both sizes in the relationship of the volume of the noble metal tip 31 and the volume of the molten portion 35 is set to satisfy 0.025≦X1/(X1+Y1)≦0.50, it is possible to more reliably prevent the overheating of the noble metal tip 31, and thereby to enhance the wear resistance.

Second Embodiment

Figure 5:
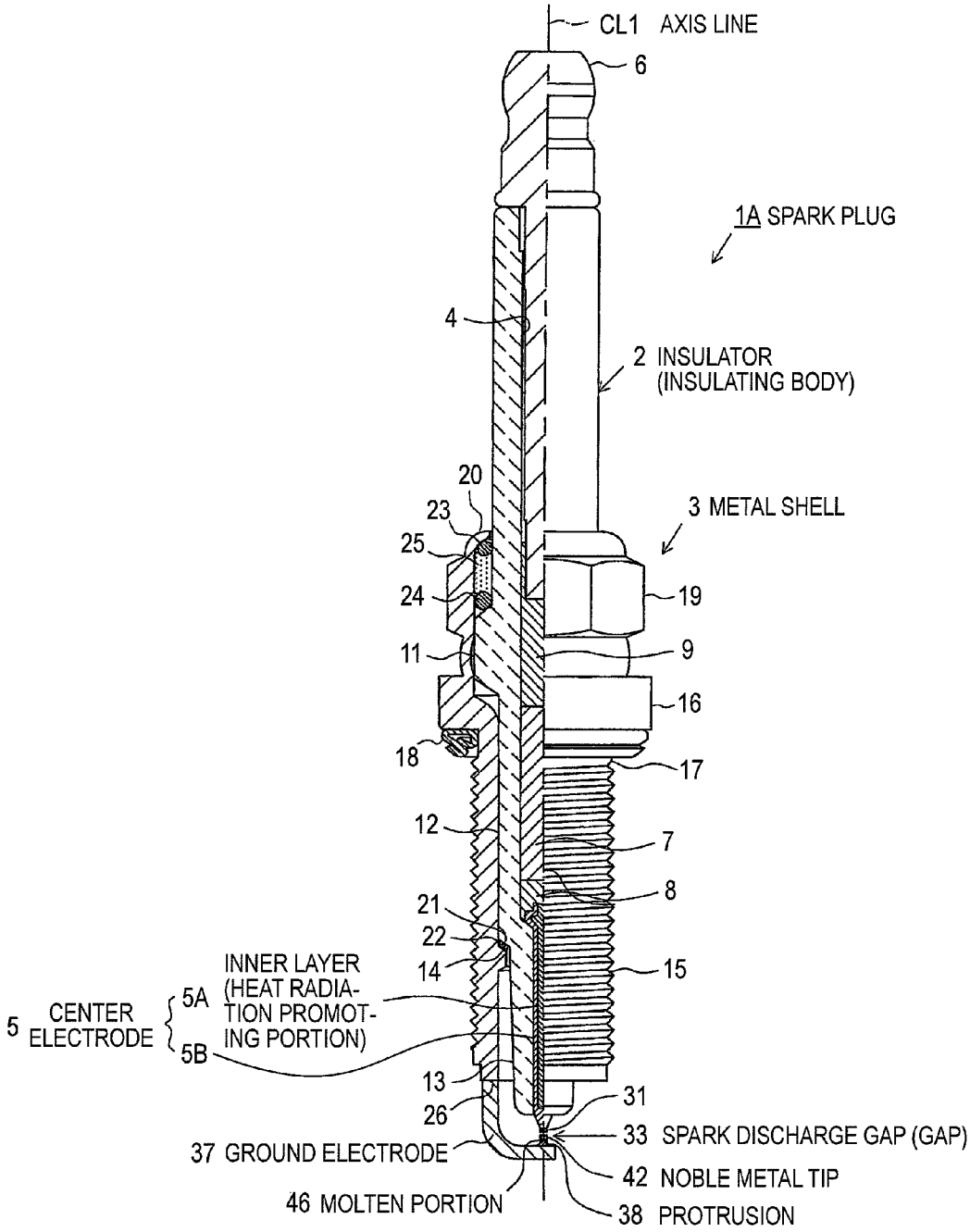
FIG. 5 is a partially-sectioned, front view illustrating the configuration of a spark plug according to a second embodiment.

Next, the second embodiment will be described, in particular, on the basis of the difference in the first embodiment and the second embodiment. In the second embodiment, the spark plug 1A includes, as shown in FIG. 5, an insulator 2, a metal shell 3, a center electrode 5, similar to the first embodiment, and a ground electrode 37, but the distal end portion of the ground electrode 37 is joined to a protrusion 38 which is made of a Ni alloy and protrudes toward the center electrode 5 side. A noble metal tip 42 is joined to the distal end portion of the protrusion 38 via a molten portion 46. In the joining, the noble metal tip 42 is joined to the protrusion 38 in such a way that the central axis of the noble metal tip 42 coincides with the axial line CL1 of the noble metal tip. In addition, the outer diameter of the noble metal tip 42 is a relatively small diameter (for example, 0.7 mm).

Figure 6:
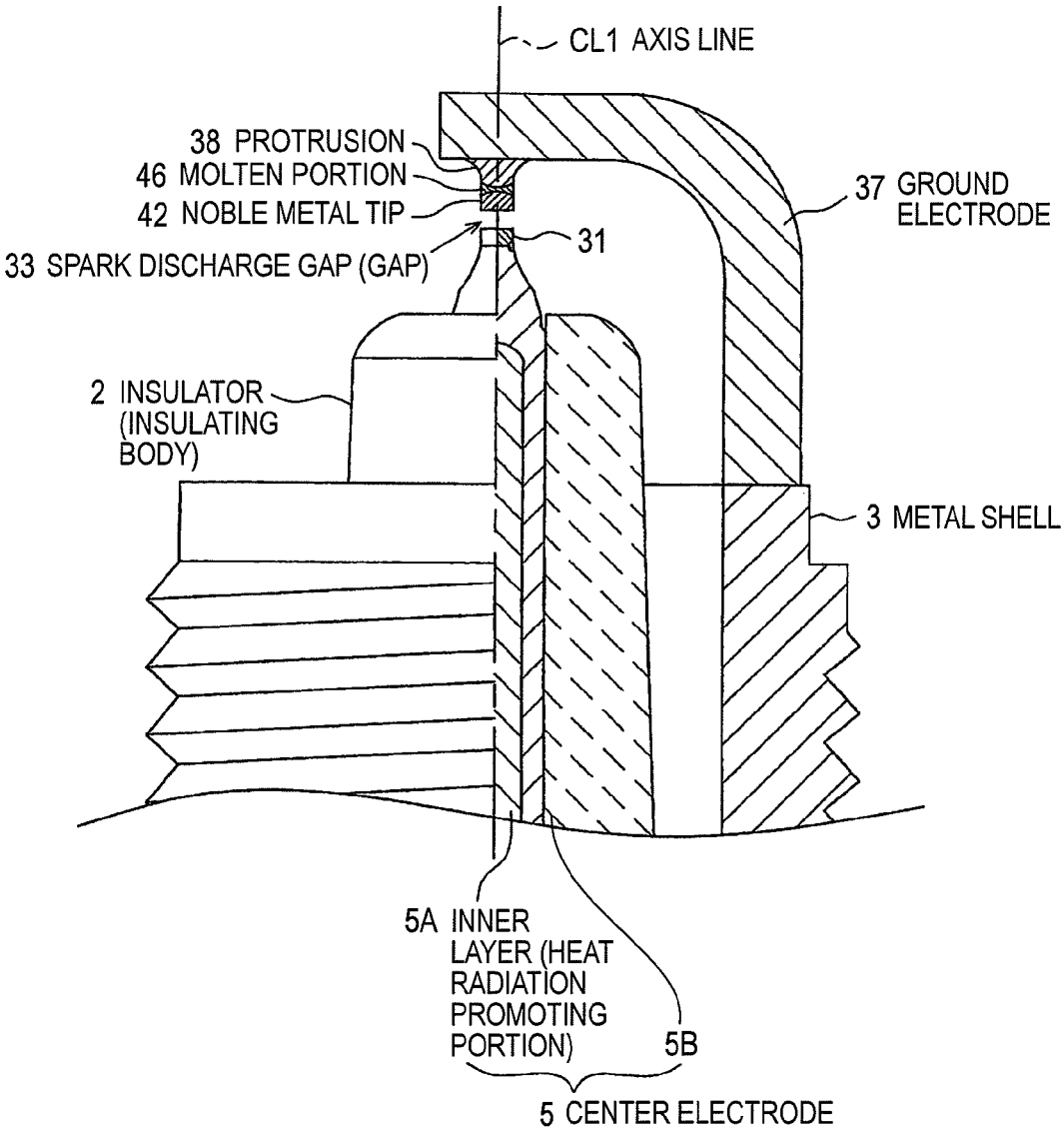
FIG. 6 is a partially-cutaway, enlarged front view illustrating the configuration of a distal end portion of a spark plug according to a second embodiment.
Figure 7:
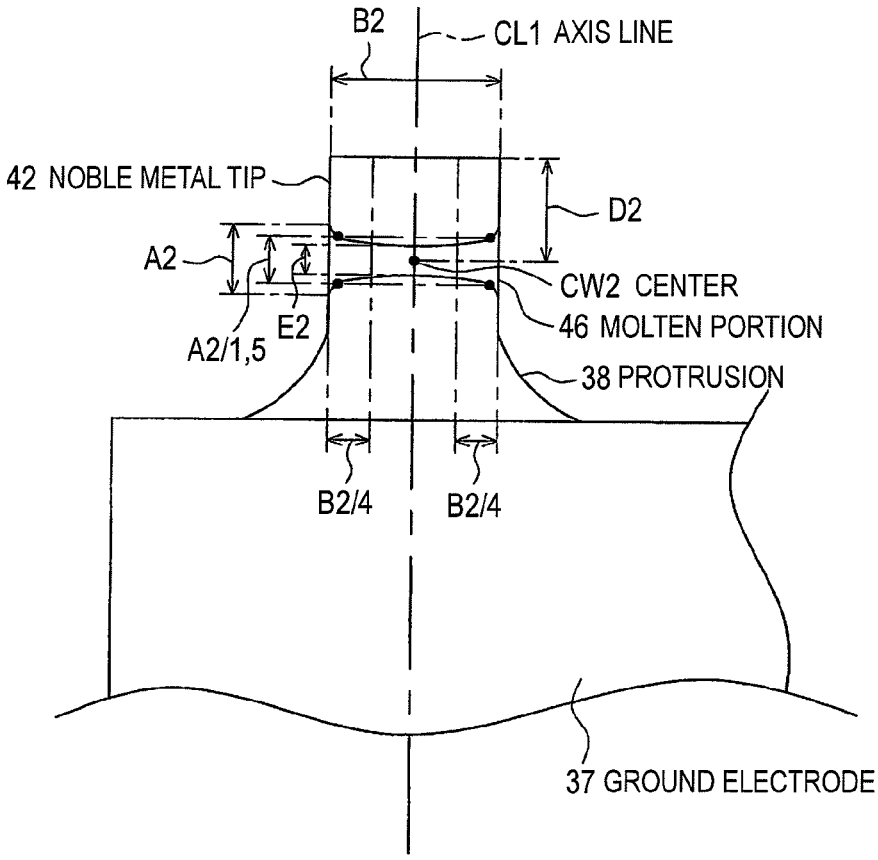
FIG. 7 is a partially-enlarged cross-sectional view schematically illustrating the configuration of a molten portion and the like according to a second embodiment.

The molten portion 46 is formed by melting a metal component (Ni alloy) of the protrusion 38 and a metal component (for example, platinum alloy) of the noble metal tip 42. In addition, as shown in FIG. 6 and FIG. 7, an area of the interface between the noble metal tip 42 and the protrusion 38 is set to be 5% or less with respect to a cross-sectional area of the noble metal tip 42 in a direction perpendicular to the axial direction of the noble metal tip 42 at a portion of the outer surface of the noble metal tip 42 which is nearest to the molten portion 46. In the second embodiment, since the molten portion 46 is formed over the whole region between the noble metal tip 42 and the protrusion 38, there is no interface between the noble metal tip 42 and the protrusion 38. That is, a ratio of the area of the interface to the cross-sectional area of the noble metal tip 42 which is orthogonal to the axial direction of the noble metal tip 42 is set to be 0%, and the thickness E2 of the molten portion 46 on the axis of the noble metal tip 42 is set to be larger than 0.0 mm.

Supposing that the length of the portion of the molten portion 46 in the axial direction of the noble metal tip 42 which is exposed to the outer surface is A2 (mm), and the width (meaning "the length of the noble metal tip 42 in a direction perpendicular to a central axis of the noble metal tip 42") of the noble metal tip 42 is B2 (mm), the cross section including the axial line CL1 is set such that B2/A2≦6 is satisfied. Further, the portion of the molten portion 46, of which the length along the axial direction of the noble metal tip 42 is A2/1.5, is located further outwards radially than a position which comes in by as much as B2/4 from the outer circumference of the noble metal tip 46. Further, the length A2 is set to be 0.4 mm or less.

Further, on the axis of the noble metal tip 42, supposing that the length from the surface, which forms the spark discharge gap 33, of the noble metal tip 42 to the center CW2 of the molten portion 46 is D2 (mm), the length D2 is set such that 0.1≦D2−(A2/2)≦0.6 and 0.3≦D2≦0.5 are satisfied.

Figure 8:
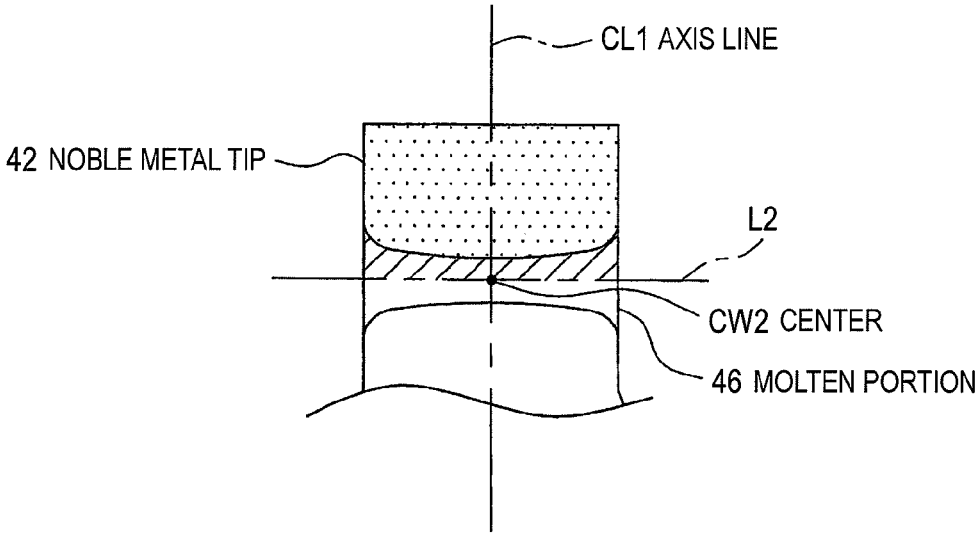
FIG. 8 is a partially-enlarged cross-sectional view schematically illustrating a cross-sectional area of a molten portion and a noble metal tip and the like according to a second embodiment.

As shown in FIG. 8, in the cross section including the axial line CL1, supposing that the cross-sectional area of the portion (portion represented by diagonal lines in FIG. 8) of the molten portion 46, which is positioned at the noble metal tip 42 side from the straight line L2 perpendicular to the central axis of the noble metal tip 42 and passing through the central portion (center CW2) of the molten portion 46 in the axial direction of the noble metal tip 42, is X2 ($mm^2$), and the cross-sectional area of the noble metal tip 42 (portion represented by scattered dots in FIG. 8) is Y2 ($mm^2$), the sizes of the molten portion 46 and the noble metal tip 42 or the like are set such that $0.025 \leqq X2/(X2+Y2) \leqq 0.50$ is satisfied.

Next, a method of manufacturing the spark plug 1A configured as described above, in particular, a method of joining the protrusion 38 to the ground electrode 37 and a method of joining the noble metal tip 42 to the protrusion 38, will be described.

When the protrusion 38 is joined to the ground electrode 37, first, the protrusion 38 of a roughly trapezoidal shape in a cross section and made of a Ni alloy is laser-welded to the noble metal tip 42. That is, in the state where an end face of the noble metal tip 42 is laid on one end face of the protrusion 38, the protrusion 38 and the like is turned around a central axis of the protrusion 38 as a rotation shaft, while the protrusion and the noble metal tip are held. At that time, a high-energy laser beam such as a fiber laser or an electron beam is intermediately irradiated onto the outer surface of the contact surface between the protrusion 38 and the noble metal tip 42. In this instance, the laser beam is irradiated in about 5 ms at 300 W from a desired laser source to form one molten region. Consequently, the molten portion 46 constituting a plurality of molten regions arranged in a circumferential direction is formed, so that the noble metal tip 42 is joined to the protrusion 38. In this instance, in a case where a material forming the outer diameter of the noble metal tip 42 is different from a material forming the noble metal tip 42 or the like, the molten portion 46 configured as described above can be formed by appropriately adjusting an output of the laser beam, an irradiation time, a rotation speed of the protrusion 38, or a method of applying the laser beam (for example, whether the laser is selected as a continuous wave or an interrupted wave (pulse) or the like).

Subsequently, the protrusion 38, to which the noble metal tip 42 is joined, is joined to the ground electrode 37. That is, the protrusion 38 is set on the ground electrode 37 formed in the shape of a straight rod. After a welding electrode rod (not illustrated) of a desired resistance welding apparatus is pressed against the inside portion (tapered portion) of the protrusion 38, an electric current is applied to the protrusion 38 side from the welding electrode rod. As a result, the contact portion between the ground electrode 37 and the protrusion 38 is molten, so that the protrusion 38 is resistance-welded to the ground electrode 37.

At that time, although the protrusion 38 is shown in the roughly trapezoidal shape in the cross section in this embodiment, for example, the roughly columnar protrusion 38 having one end which is swollen in the shape of a blade may be used. In this instance, when the resistance welding is carried out, the protrusion 38 may be joined to the ground electrode 37 by pressing the welding electrode rod against the blade-shaped portion to apply the electric current thereto.

According to the second embodiment, the working effect according to the first embodiment which appears in the relationship between the center electrode 5 and the noble metal tip 31 also appears in the relationship between the protrusion 38 and the noble metal tip 42 in the case where the protrusion 38 of the ground electrode 37 is joined to the noble metal tip 42.

[Verification by Test]

In order to verify the working effects that appears in the above-described embodiments, after the area ratio of the interface (interface ratio) between the noble metal tip and the center electrode to the cross-sectional area of the noble metal tip orthogonal to the axial direction of the noble metal tip at the portion of the outer surface of the noble metal tip, which is nearest to the molten portion, is set to be 5% or 10% by altering the welding condition of the noble metal tip to the center electrode, samples of the spark plugs, of which the ratios (B/A) of the width B (mm) of the noble metal tip to the length A (mm) of the portion of the molten portion, which is exposed to the outer surface, in the axial direction of the noble metal tip are variously altered, are manufactured, and then each sample is subjected to a desk burner test.

Figure 9:
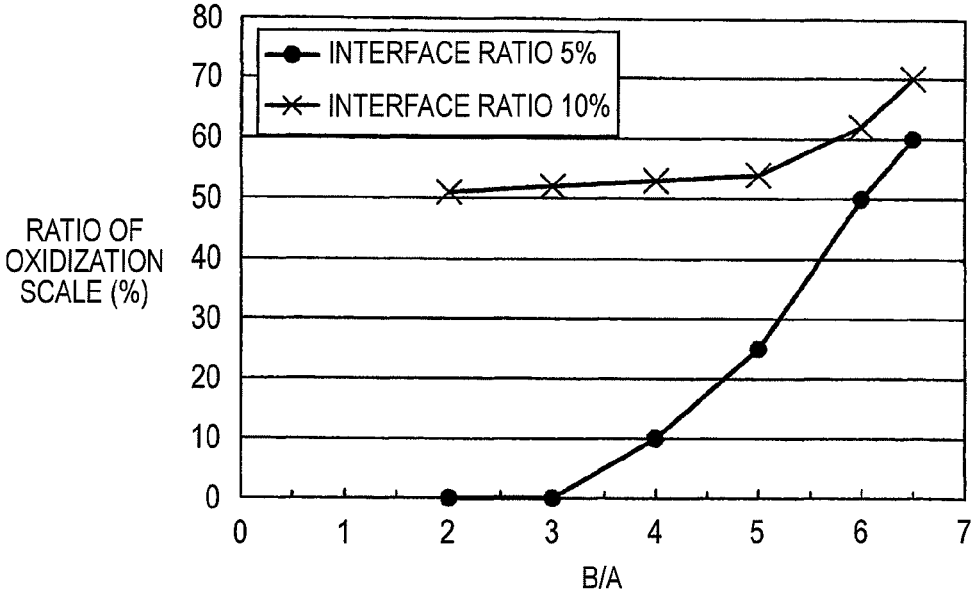
FIG. 9 is a graph illustrating a relationship of B/A and a ratio of oxidization scale for samples of which an interface radio is 5% or 10%.

The outline of the desk burner test is as follows. That is, one cycle is set such that after the samples are heated by a burner for 2 minutes until the temperature of the noble metal tip reaches 900° C., and then the samples are annealed for 1 minute. 1000 cycles are performed, and after 1000 cycles are completed, the cross section of the respective samples is observed to measure the ratio (oxidation scale ratio) of the length of oxidation scale formed on the interface to the length of the interface between the molten portion, the center electrode and the noble metal tip. FIG. 9 shows the relationship of B/A and the oxidization scale ratio with respect to the samples of which the interface ratio is 5% or 10%. In this instance, in FIG. 9, the test result of the sample, of which the interface ratio is set as 5%, is plotted by a black circle (●), while the test result of the sample, of which the interface ratio is set as 10%, is plotted by a cross (X). In addition, the noble metal tip having an outer diameter of 0.7 mm is used.

As shown in FIG. 9, for the sample, of which the interface ratio is 10%, it can be seen that the ratio of oxidation scale exceeds 50%, and thus the joining strength of the noble metal tip to the center electrode is not sufficient. The reason is that the direct contact region between the center electrode and the noble metal tip is relatively large (in other words, the volume of the molten portion is relatively small). Therefore, it is considered that the molten portion could not sufficiently absorb the difference in thermal stress generated between the center electrode and the noble metal tip, and thus, the generation of the oxidization scale is not sufficiently prevented.

In addition, for the sample of which the B/A exceeds 6, it can be seen that the ratio of oxidation scale exceeds 50%. The reason is that the molten portion with respect to the noble metal tip is relatively thin. Therefore, it is considered that it could not sufficiently absorb the difference in thermal stress generated between the center electrode and the noble metal tip.

In the meantime, for the sample of which the interface ratio is 5% or less, and $B/A \leqq 6$ is set, it can be seen that the ratio of oxidation scale falls short of 50%, such that the noble metal tip is firmly joined to the center electrode, thereby reliably preventing separation of the noble metal tip from the center electrode.

Then, after the length A is set as 0.4 mm or 0.6 mm, the portion of the molten portion, of which the length in the axial line is set to be A/1.5, is respectively formed at positions of B/6, B/5, B/4, B/3 or B/2.5 towards the inside from the outer circumference of the noble metal tip, thereby manufacturing samples for the spark plug. Each of the samples is subjected to a desk spark test.

Figure 10:
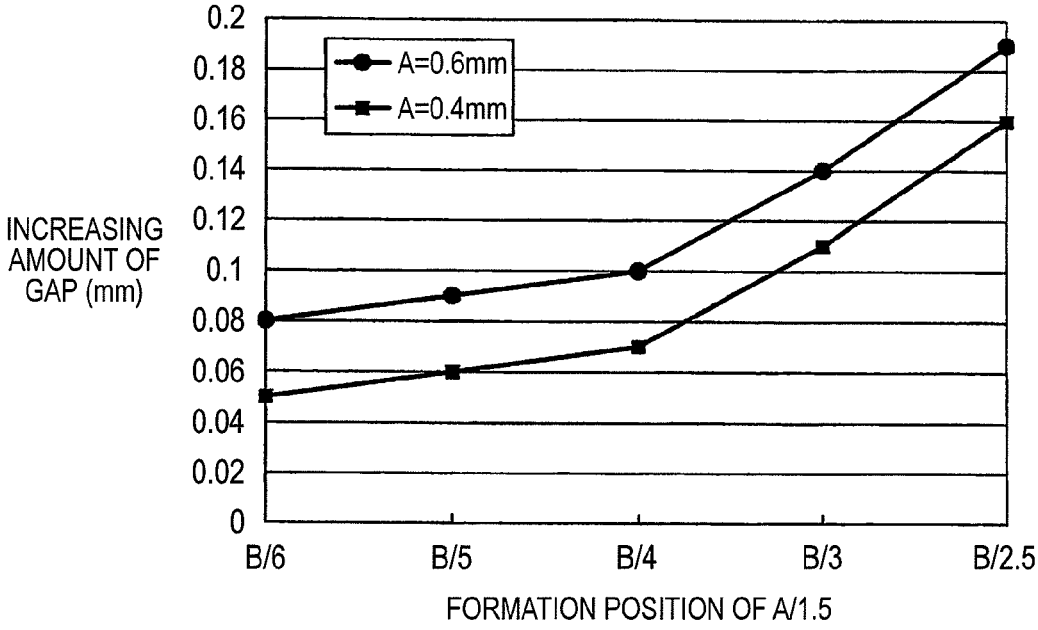
FIG. 10 is a graph illustrating a relationship of a formation position of A/1.5 and an increasing amount of a gap.

In this instance, the outline of the desk spark test is as follows. That is, after the frequency of the voltage applied to the sample is set as 60 Hz (that is, after discharge of 3600 times per one minute is carried out), each sample is discharged for 100 hours. After the lapse of 100 hours, the increasing amount of the spark discharge gap (increasing amount of gap) of each sample is measured. FIG. 10 shows the relationship between the formation position (formation position of A/1.5) of the portion of A1/1.5 which is from the outer circumference of the noble metal tip, and the increasing amount of the gap. In this instance, in FIG. 10, the test result of the sample, of which A is set as 0.6 mm, is plotted by a black circle (●), while the test result of the sample, of which A is set as 0.4 mm, is plotted by a black rectangle (■). In addition, the noble metal tip having an outer diameter of 0.7 mm and a height (thickness) of 0.3 mm is used.

As shown in FIG. 10, for the sample, in which the formation position portion, of which the length in the axial line is set to be A/1.5, of the molten portion is formed further outwards radially than B/4 from the outer circumference of the noble metal tip (that is, the sample of which the formation position of A/1.5 is set to be B/6, B/5 or B/4), it can be seen that the increasing amount of the gap is less than 0.1 mm, and it has the superior wear resistance. It is considered that as the formation position of A/1.5 is set further outwards radially than the position which comes in by as much as B/4 from the outer circumference of the noble metal tip, the shape of the molten portion can be relatively thin, so that the noble metal tip is not excessively molten at the time of joining the noble metal tip, and thus the thickness of the noble metal tip can be sufficiently secured after joining.

In addition, it is verified that the sample, of which A is set to be 0.4 mm or less, has the wear resistance higher than the sample of which A is set to be 0.6 mm. It is considered that as A is set to be 0.4 mm or less, the thickness of the noble metal tip can be sufficiently secured after joining.

Taking the results of both tests collectively into consideration, in order to both enhance the wear resistance and the joining strength, it would be preferable that the interface ratio is set to be 5% or less, $A \leqq 0.6$ and $B/A \leqq 6$ are satisfied, and the formation position of the portion, of which the length in the axial line is set to be A/1.5, of the molten portion is formed further outwards radially than B/4 from the outer circumference of the noble metal tip.

In addition, in view of further enhancing the wear resistance, it would be preferable that the molten portion is formed in such a way that A is set to be 0.4 mm or less.

Next, after the length A of the molten portion is set as 0.4 mm, the length D from the surface of the noble metal tip, which forms the spark discharge gap, to the center of the molten portion is altered, thereby manufacturing samples of spark plugs having variously altered values of D−(A/2). Each of the samples is subjected to a test for evaluating the wear resistance.

Figure 11:
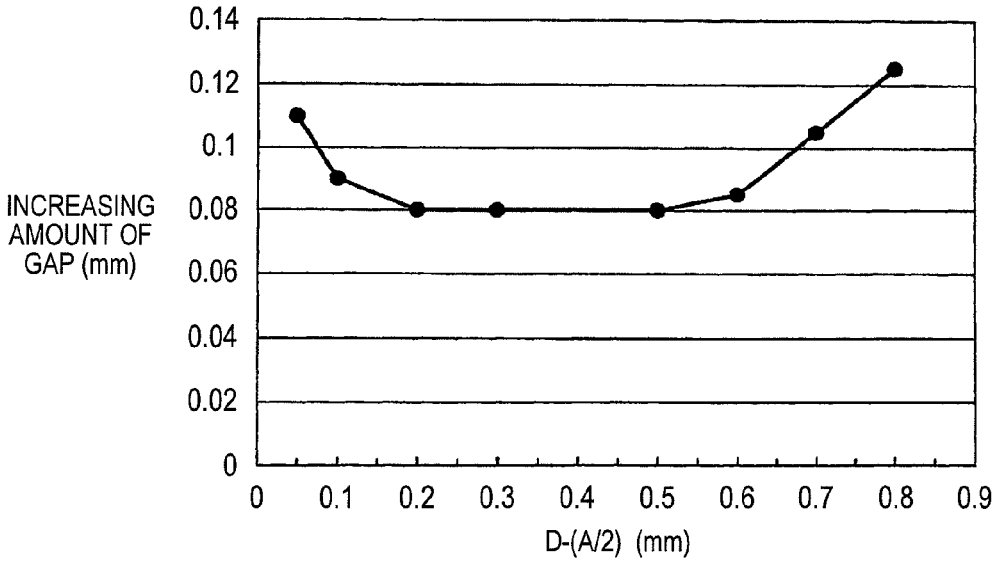
FIG. 11 is a graph illustrating a relationship of values of $D-(A/2)$ and an increasing amount of a gap.

In this instance, the outline of the test evaluating the wear resistance is as follows. That is, after the sample manufactured by itself is attached to a V4 engine having a displacement volume of 2000 cc, the target maintaining temperature of the distal end portion of the center electrode is 800° C., and the engine is driven for 100 hours in the full open state (engine speed=5000 rpm). After the lapse of 100 hours, the increasing amount (increasing amount of gap) of the spark discharge gap of each sample is measured. FIG. 11 shows the relationship of the value of D−(A/2) and the increasing amount of the gap. In this instance, the noble metal tip having the outer diameter of 0.7 mm is used.

As shown in FIG. 11, it is verified that for the sample of which D−(A/2) is less than 0.1 mm, that is, the sample of which the length from the molten portion to the distal end face (discharge surface) of the noble metal tip is relatively short, the increasing amount of the gap exceeds 0.1 mm, so that the wear resistance is slightly lowered. It is considered that since the volume of the noble metal tip is decreased, the molten portion is exposed to the discharge surface at a comparatively early stage. It is verified that for the sample of which D−(A/2) is larger than 0.6 mm, that is, the sample of which the length from the molten portion to the distal end face of the noble metal tip is relatively long, the wear resistance is slightly lowered. It is considered that since the volume of the noble metal tip is increased too much, the heat of the noble metal tip is difficult to be drawn, so that the noble metal tip is overheated.

On the other hand, it can be seen that for the sample satisfying $0.1\ \text{mm} \leqq D-(A/2) \leqq 0.6\ \text{mm}$, the increasing amount of the gap is less than 0.1 mm, so that it has very superior wear resistance. In particular, it is verified that for the sample satisfying $0.2\ \text{mm} \leqq D-(A/2) \leqq 0.5\ \text{mm}$, the increasing amount of the gap is further decreased, so that more superior wear resistance is achieved. Accordingly, in order to further enhance the wear resistance, it is preferable to form the molten portion or the like to satisfy $0.1\ \text{mm} \leqq D-(A/2) \leqq 0.6\ \text{mm}$, more preferably, to form the molten portion or the like to satisfy $0.2\ \text{mm} \leqq D-(A/2) \leqq 0.5\ \text{mm}$.

Figure 12:
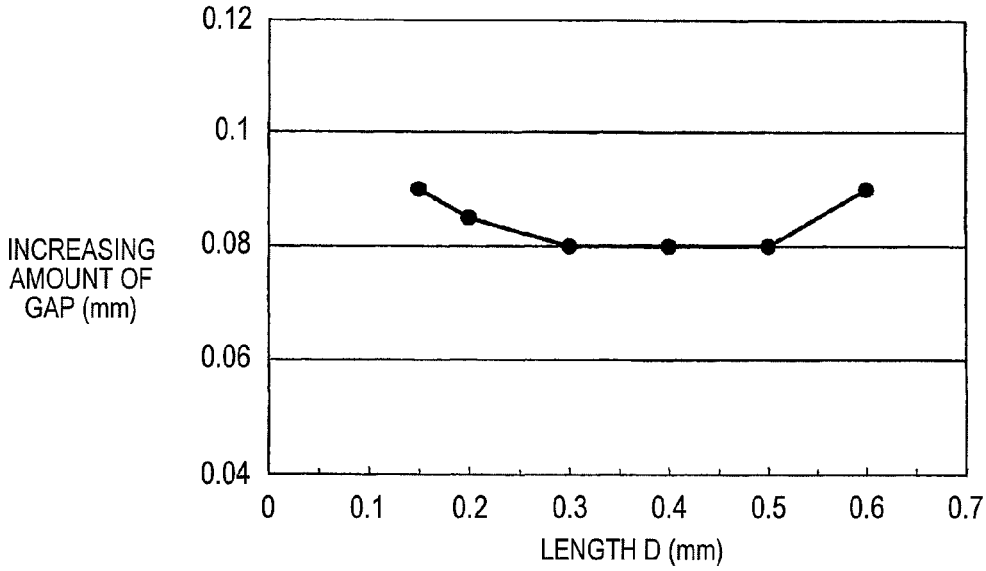
FIG. 12 is a graph illustrating a relationship of a length D and an increasing amount of a gap.

Next, after samples of the spark plugs having variously altered length D are manufactured by using a plurality of noble metal tips having different height (thickness), each of the samples is subjected to a test for evaluating the above-described durability. FIG. 12 shows the relationship between the length D and the increasing amount of the gap. In this instance, the noble metal tip has the outer diameter of 0.7 mm, and the welding of the noble metal tip is carried out to allow the molten portion to have the length A of 0.4 mm.

As shown in FIG. 12, for the sample satisfying $0.3\ \text{mm} \leqq D \leqq 0.5\ \text{mm}$, it can be seen that the increasing amount of the gap is decreased in order of 0.08 mm, thereby achieving the superior wear resistance. Accordingly, in view of further enhancing the wear resistance, it is preferable for the length D to set the thickness of the noble metal tip or the like so as to satisfy $0.3\ \text{mm} \leqq D \leqq 0.5\ \text{mm}$.

Next, after plural samples of the spark plugs, of which the thickness E of the molten portion on the axis of the noble metal tip is 0 mm, 0.05 mm or 0.10 mm, are manufactured by altering the welding condition of the noble metal tip in various, each of the samples is subjected to the above-described desk burner test. The length of the formed oxidization scale is measured. As a result, if the ratio of the oxidization scale is 30% or less, the sample has the superior joining strength, and thus it is evaluated as "◎". If the ratio of the oxidization scale is more than 30% and 50% or less, the sample has the sufficient joining strength, and thus it is evaluated as "O". Table 1 shows the thickness E of the molten portion and the evaluation. In this instance, the sample, of which the molten portion has 0 mm in thickness E, means that the molten portion does not exist on the axis of the noble metal tip (wherein, the interface ratio is set to be 5% or less). In addition, the noble metal tip having an outer diameter of 0.7 mm is used. Further, the noble metal tip is welded in such a way that the molten portion has a length A of 0.4 mm.

TABLE 1

| Thickness E of molten portion (mm) | Evaluation |
|---|---|
| 0 | ○ |
| 0.05 | ◎ |
| 0.10 | ◎ |

As shown in Table 1, although each of the samples has the superior joining strength, in particular, it is verified that the sample, of which the molten portion has 0.05 mm or 0.10 mm in thickness E (that is, the molten portion exists on the axis of the noble metal tip) has the very superior joining strength. Accordingly, in view of further enhancing the joining strength, it is preferable to let the molten portion remain on the axis of the noble metal tip (E>0.0 mm), in other words, to form the molten portion over the whole region between the noble metal tip and the center electrode.

Figure 13:
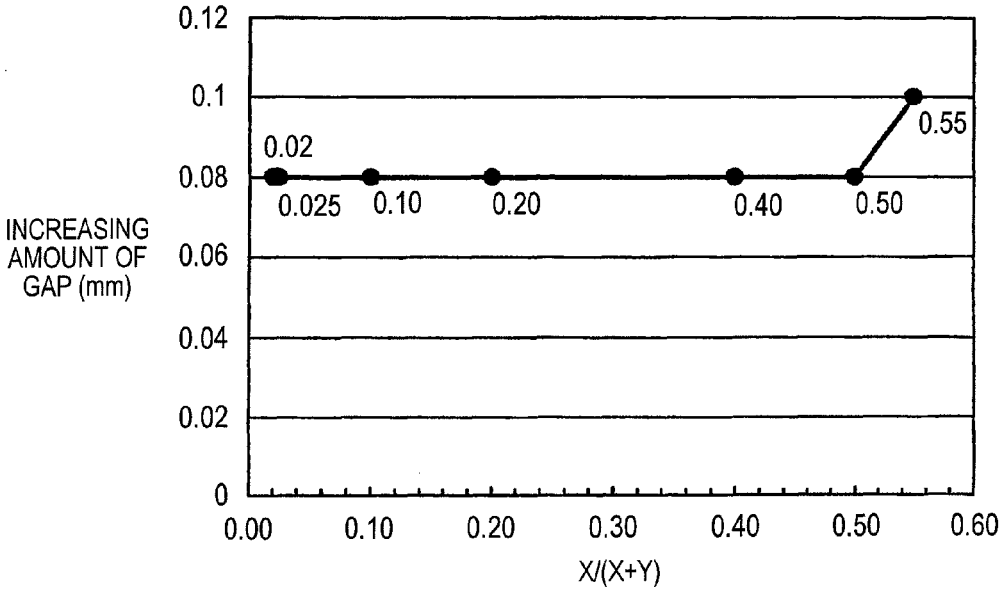
FIG. 13 is a graph illustrating a relationship of values of $X/(X+Y)$ and an increasing amount of a gap.

Next, by variously altering the welding condition such that the length A of the molten portion becomes 0.05 mm to 0.4 mm, in the cross section including the axial line, samples of the spark plugs are manufactured by altering the cross-sectional area X ($mm^2$) of the portion of the molten portion, which is positioned at the noble metal tip side from the straight line orthogonal to the central axis (axial line) of the noble metal tip and passing through the central portion of the molten portion in the direction of the axial line, and the cross-sectional area Y ($mm^2$) of the noble metal tip, and then each of the samples is subjected to the above-described desk spark test and the above-described desk burner test. In the desk burner test, similar to the above-described evaluation method, if the ratio of the oxidization scale is 30% or less, the sample is evaluated as "◎", and if the ratio of the oxidization scale is more than 30% and 50% or less, the sample is evaluated as "O". FIG. 13 shows the relationship of the value of X/(X+Y) and the increasing amount of the gap in the desk spark test, and Table 2 shows the values of X/(X+Y) and the evaluation in the desk burner test. In this instance, the noble metal tip having 0.7 mm in outer diameter is used.

TABLE 2

| X/(X + Y) | Evaluation |
|---|---|
| 0.02 | ○ |
| 0.025 | ◎ |
| 0.10 | ◎ |
| 0.45 | ◎ |
| 0.50 | ◎ |

As shown in FIG. 13, it is verified that the sample of X/(X+Y)≦0.50 has the superior wear resistance. It is considered that the reason is that the noble metal tip has the sufficient volume, and thus the volume of the noble metal tip which can be consumed upon discharge is increased. In addition, it can be seen that the sample of 0.025≦X/(X+Y) has very superior joining strength between the center electrode and the noble metal tip. It is considered that the molten portion has the sufficient volume, and thus the difference in the thermal stress between the noble metal tip and the center electrode can be more reliably absorbed.

Accordingly, in order to further enhance the wear resistance and the joining strength, it is preferable to set the shapes of the noble metal tip and molten portion, and welding conditions so as to satisfy 0.025≦X/(X+Y)≦0.50.

Figure 14:
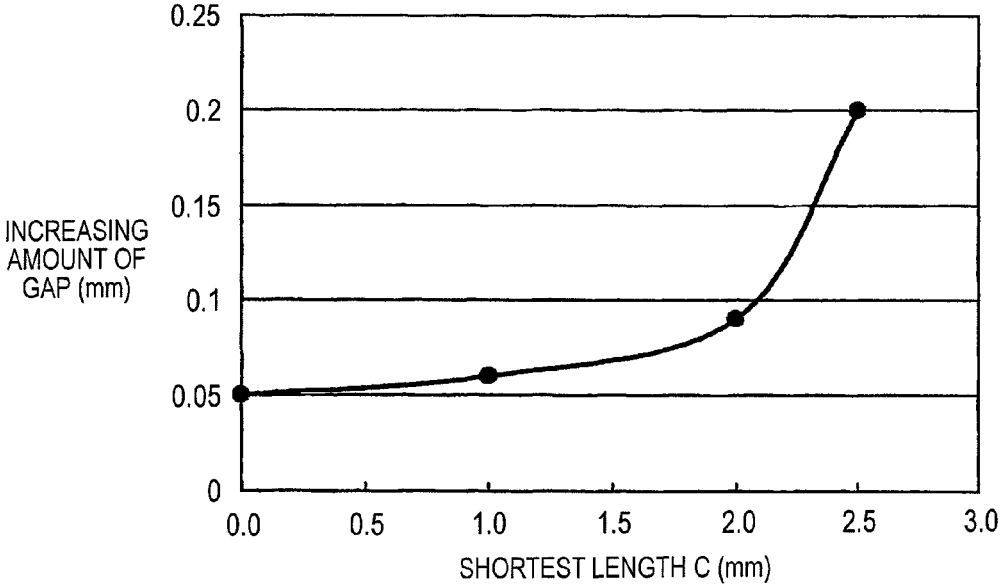
FIG. 14 is a graph illustrating a relationship of the shortest length C between a molten portion and a heat radiation promoting portion, and an increasing amount of a gap.

Next, samples of the spark plugs are manufactured by variously altering the shortest length C (mm) from the inner layer (the hear radiation promoting portion) provided in the center electrode to the molten portion, and then each of the samples is subjected to the test of evaluating the durability. FIG. 14 shows the relationship of the shortest length C and the increasing amount of the gap. In this instance, the inner layer is made of a metal (for example, copper, copper alloy or the like) which is superior to the outer layer of the center electrode made of the Ni alloy in terms of thermal conductivity. In addition, the noble metal tip having the outer diameter of 0.7 mm and the height of 0.25 mm before the welding is used. Further, the center electrode and the noble metal tip are joined to each other such that the length A of the molten portion is 0.4 mm.

As shown in FIG. 14, it can be seen that in the case of the sample, of which the shortest length C is more than 2.0 mm, the increasing amount of the gap is suddenly increased. It is considered that the length between the inner layer having the superior heat attraction, and the molten portion and the noble metal tip is relatively increased, and thus it is difficult to attract the heat of the molten portion and the noble metal tip, so that the noble metal tip is overheated.

On the other hand, it can be seen that in the case of the sample, of which the shortest length C is 2.0 mm or less, the increasing amount of the gap is less than 0.1 mm, thereby achieving very superior wear resistance. It is considered that the heat of the molten portion and the noble metal tip is effectively transmitted to the inner layer, and thus the overheating of the noble metal tip is reliably prevented.

Accordingly, in order to further enhance the wear resistance, it is preferable to provide the inside of the center electrode with the portion having the superior heat conductivity (the heat radiation promoting portion) and set the shortest length C between the heat radiation promoting portion and the molten portion as 2.0 mm or less.

The present invention is not limited to the descriptions about the embodiments but can also be implemented as follows, for example. As a matter of course, it is natural that another example application or modification of the present invention, which is not provided below, will be possible.

Figure 16:
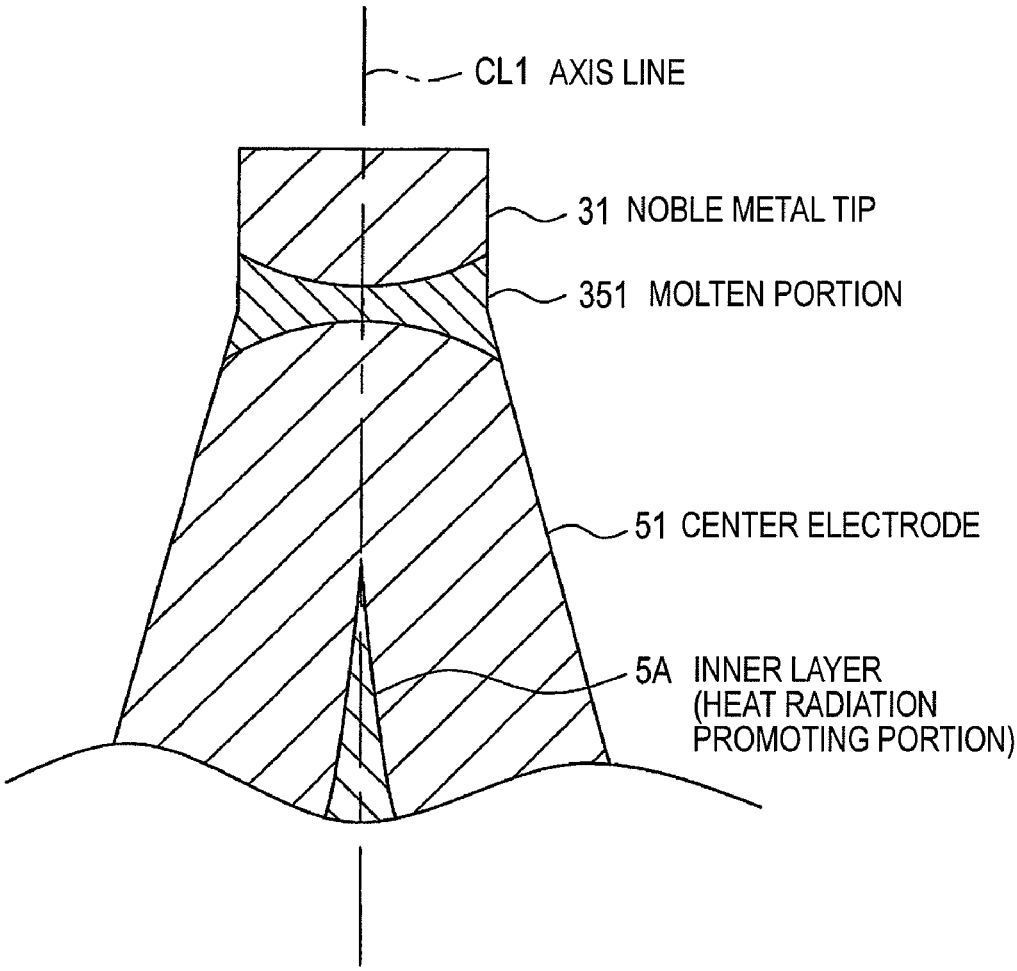
FIG. 16 is a partially-enlarged cross-sectional view illustrating the configuration of a distal end portion of a center electrode according to another embodiment.

(a) In the embodiments, the distal end portion of the center electrode 5 is formed in the columnar shape, but the shape of the center electrode 5 is not limited thereto. Accordingly, as shown in FIG. 16, the distal end portion of the center electrode 51 can be tapered off toward the distal end in the direction of the axial line CL1.

Figure 17:
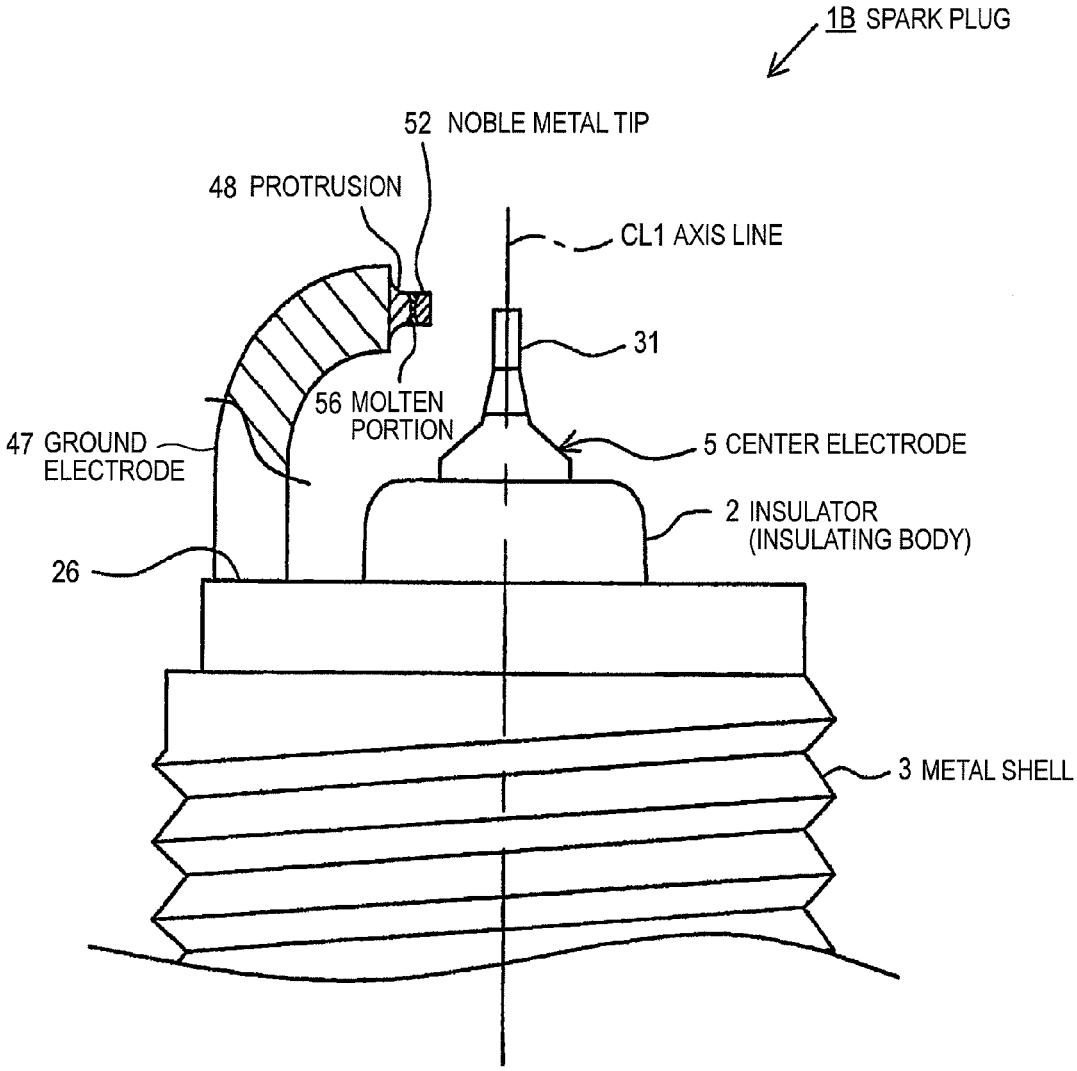
FIG. 17 is a partially-enlarged, front view illustrating the configuration of a spark plug according to another embodiment.

(b) In the embodiments, the types of spark plugs 1 and 1A are disclosed in which the spark discharge is performed at the spark discharge gap 33 in the direction almost following the axial line CL1, but types of the spark plug to which the technical ideas of the present invention can be applied is not limited thereto. Accordingly, as shown in FIG. 17, the technical ideas of the present invention can be applied to the type of spark plug 1B capable of performing the spark discharge in the direction substantially perpendicular to the axial line CL1, in which the noble metal tip 52 is joined to the protrusion 38 provided on the distal end portion of the ground electrode 47 via the molten portion 56. In addition, the technical ideas of the present invention can be applied to the type of the spark plug capable of performing the spark discharge in a slope direction with respect to the axial line CL1.

(c) In the second embodiment, the separate protrusion 38 is provided on the distal end portion of the ground electrode 37, but the ground electrode and the protrusion can be integrally provided by forming the ground electrode or the like.

(d) In the embodiments, the interface between the molten portion 35 and the noble metal tip 31 and the interface between the molten portion 35 and the center electrode 5 are curved in such a way that each is concaved toward the outer circumference of the molten portion 35, but the cross-sectional shape of the molten portion 35 is not limited thereto.

(e) In the embodiments, it is configured in such a way that the axial line CL1 coincides with the central axis of the noble metal tips 31 and 42, but the noble metal tips 31 and 42 can be joined to the center electrode 5 and the protrusion 38 in a state where the center of the noble metal tips 31 and 42 is shifted from up the axial line CL1.

(f) In the embodiments, the case in which the ground electrode 27 or the like is joined to the distal end portion 26 of the metal shell 3 is exemplified, but the invention is also applicable to a case in which the ground electrode is formed in such a manner as to shave off a portion of the metal shell (or a portion of a tip fitting welded in advance to the metal shell) (for example, refer to JP-A-2006-236906).

(g) In the embodiments, the tool engaging portion 19 is provided with a hexagonal cross-sectional shape, but the shape of the tool engaging portion 23 is not limited thereto. For example, the tool engaging portion may have a Bi-HEX (modified 12-point) shape [IS 022977:2005(E)] or the like.

DESCRIPTION OF REFERENCE NUMERALS AND SIGNS

1, 1A, 1B: spark plug
2: insulator (insulating body)
3: metal shell
5: center electrode
5A: inner layer (heat radiation promoting portion)
27, 37, 47: ground electrode
31, 42, 52: noble metal tip
33: spark discharge gap (gap)
35, 46, 56: molten portion
38, 48: protrusion
Bo: interface
CL1: axial line
CW1, CW2: center (of molten portion)

The invention claimed is:

1. A spark plug comprising:

a rod-shaped center electrode extending in an axial direction thereof;

an insulating body provided around an outer circumference of the center electrode;

a metal shell provided around an outer circumference of the insulating body;

a ground electrode extending from a distal end portion of the metal shell; and a noble metal tip joined to a distal end portion of the center electrode, and forming a gap between the ground electrode and the noble metal tip, wherein the center electrode and the noble metal tip are joined to each other through a molten portion which is fused with a component of the center electrode and a component of the noble metal tip;

an area of an interface between the noble metal tip and the center electrode is set to be 5% or less with respect to a cross-sectional area of the noble metal tip which is perpendicular to an axial line of the nobel metal tip at a portion, which is nearest to the molten portion, of an outer surface of the noble metal tip;

in a cross section including the axial line, supposing that a length of a portion, which is exposed to the outer surface is A (mm), of the molten portion along the axial line, and a width of the noble metal tip is B (mm), $A \leqq 0.6$ and $B/A \leqq 6$ are satisfied; and a portion of the molten portion, of which a length along the axial line is A/1.5, is located further outwards radially than a position which comes in by as much as B/4 from the outer circumference of the noble metal tip.

2. The spark plug according to claim 1, wherein the center electrode is provided therein with a heat radiation promoting portion made of a material superior to the outer circumference of the center electrode in terms of thermal conductivity, and supposing that the shortest length from the heat radiation promoting portion to the molten portion is C (mm), $C \leqq 2.0$ is satisfied.

3. The spark plug according to claim 1, wherein $A \leqq 0.4$ is satisfied.

4. The spark plug according to claim 1, wherein, in the axial line of the noble metal tip, supposing that a length from a surface, which forms the gap, of the noble metal tip to a center of the molten portion or the interface is D (mm), $0.1 \leqq D-(A/2) \leqq 0.6$ is satisfied.

5. The spark plug according to claim 1, wherein, in the axial line of the noble metal tip, supposing that a length from a surface, which forms the gap, of the noble metal tip to a center of the molten portion or the interface is D (mm), $0.3 \leqq D \leqq 0.5$ is satisfied.

6. The spark plug according to claim 1, wherein, in the axial line of the noble metal tip, supposing that a thickness of the molten portion is E (mm), $E>0.0$ is satisfied.

7. The spark plug according to claim 5, wherein in a cross section including the axial line, supposing that a cross-sectional area of the portion of the molten portion, which is positioned at the noble metal tip side from a straight line perpendicular to a central axis of the noble metal tip and passing through a central portion of the molten portion in a direction of the axial line of the noble metal tip, is X ($mm^2$), and a cross-sectional area of the noble metal tip is Y ($mm^2$), $0.025 \leqq X/(X+Y) \leqq 0.50$ is satisfied.

8. A spark plug comprising:

a rod-shaped center electrode extending in an axial direction thereof;

an insulating body provided around an outer circumference of the center electrode;

a metal shell provided around an outer circumference of the insulating body;

a ground electrode extending from a distal end portion of the metal shell; and a noble metal tip joined to a protrusion provided on a distal end portion of the ground electrode, and forming a gap between the center electrode and the noble metal tip, wherein the protrusion and the noble metal tip are joined to each other through a molten portion which is fused with a component of the protrusion and a component of the noble metal tip;

an area of an interface between the noble metal tip and the protrusion is set to be 5% or less with respect to a cross-sectional area of the noble metal tip which is perpendicular to an axial line of the noble metal tip at a portion, which is nearest to the molten portion, of an outer surface of the noble metal tip;

in a cross section including the axial line, supposing that a length of a portion, which is exposed to the outer surface is A (mm), of the molten portion in the axial direction of the noble metal tip, and a width of the noble metal tip is B (mm), $A \leqq 0.6$ and $B/A \leqq 6$ are satisfied; and a portion of the molten portion, of which a length along the axial direction of the noble metal tip is A/1.5, is located further outwards radially than a position which comes in by as much as B/4 from the outer circumference of the molten portion.

* * * * *